US009499885B2

(12) United States Patent
Onda

(10) Patent No.: US 9,499,885 B2
(45) Date of Patent: Nov. 22, 2016

(54) CU—SI—CO ALLOY FOR ELECTRONIC MATERIALS, AND METHOD FOR PRODUCING SAME

(75) Inventor: Takuma Onda, Hitachi (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 899 days.

(21) Appl. No.: 13/641,321

(22) PCT Filed: Apr. 8, 2011

(86) PCT No.: PCT/JP2011/058921

§ 371 (c)(1),
(2), (4) Date: Dec. 19, 2012

(87) PCT Pub. No.: WO2011/129281

PCT Pub. Date: Oct. 20, 2011

(65) Prior Publication Data

US 2013/0098511 A1 Apr. 25, 2013

(30) Foreign Application Priority Data

Apr. 14, 2010 (JP) ..... 2010-093205

(51) Int. Cl.

| | |
|---|---|
| ***C22C 9/06*** | (2006.01) |
| ***C22F 1/08*** | (2006.01) |
| ***H01B 1/02*** | (2006.01) |

(52) U.S. Cl.
CPC . *C22C 9/06* (2013.01); *C22F 1/08* (2013.01); *H01B 1/026* (2013.01)

(58) Field of Classification Search
CPC ..... C22C 9/06; C22C 9/10
USPC ..... 148/411–414, 432–436, 554; 420/469–482, 489, 490, 496
See application file for complete search history.

(56) References Cited

U.S. PATENT DOCUMENTS

| | | | |
|---|---|---|---|
| 2004/0079456 | A1 | 4/2004 | Mandigo et al. |
| 2010/0193092 | A1 | 8/2010 | Matsuo et al. |
| 2010/0326573 | A1 | 12/2010 | Mihara et al. |
| 2011/0073221 | A1 | 3/2011 | Kaneko et al. |
| 2011/0186192 | A1 | 8/2011 | Mihara et al. |

(Continued)

FOREIGN PATENT DOCUMENTS

| | | | |
|---|---|---|---|
| EP | 1873267 | A1 | 1/2008 |
| EP | 2143810 | A1 | 1/2010 |

(Continued)

OTHER PUBLICATIONS

English language machine translation of JP 2010-059543 to Matsuo et al. Generated Mar. 5, 2016.*

(Continued)

*Primary Examiner* — Brian Walck
(74) *Attorney, Agent, or Firm* — Drinker Biddle & Reath LLP

(57) ABSTRACT

A Cu—Co—Si alloy having an improved balance between electrical conductivity and strength is provided. Disclosed is a copper alloy for electronic materials, which contains 0.5% to 4.0% by mass of Co and 0.1% to 1.2% by mass of Si, with the balance being Cu and unavoidable impurities, and in which the mass % ratio of Co and Si (Co/Si) is 3.5≤Co/Si≤5.5, an area ratio of discontinuous precipitation (DP) cells is 5% or less, and an average value of a maximum width of discontinuous precipitation (DP) cells is 2 μm or less.

11 Claims, 1 Drawing Sheet

(56) References Cited

U.S. PATENT DOCUMENTS

| | | | |
|---|---|---|---|
| 2011/0200480 | A1 | 8/2011 | Matsuo et al. |
| 2012/0031533 | A1 | 2/2012 | Onda et al. |

FOREIGN PATENT DOCUMENTS

| | | | |
|---|---|---|---|
| EP | 2319947 | A1 | 5/2011 |
| EP | 2386665 | A1 | 11/2011 |
| JP | 9-20943 | A | 1/1997 |
| JP | 09-020943 | A | 1/1997 |
| JP | 11-222641 | A | 8/1999 |
| JP | 2005-532477 | A | 10/2005 |
| JP | 2007-169764 | A | 7/2007 |
| JP | 2007-169765 | A | 7/2007 |
| JP | 2007-246931 | A | 9/2007 |
| JP | 2008-88512 | A | 4/2008 |
| JP | 2008-088512 | A | 4/2008 |
| JP | 2008-248333 | A | 10/2008 |
| JP | 2008-266783 | A | 11/2008 |
| JP | 2008-266787 | A | 11/2008 |
| JP | 2009-242814 | A | 10/2009 |
| JP | 2009-242890 | A | 10/2009 |
| JP | 2009-242932 | A | 10/2009 |
| JP | 2010-059543 | A | 3/2010 |
| JP | 2010-59543 | A | 3/2010 |
| WO | 2004/005560 | A2 | 1/2004 |
| WO | 2006/109801 | A1 | 10/2006 |
| WO | 2008/041696 | A1 | 4/2008 |
| WO | 2008/126681 | A1 | 10/2008 |
| WO | 2009/096546 | A1 | 8/2009 |
| WO | 2009/148101 | A1 | 12/2009 |
| WO | 2010/013790 | A1 | 2/2010 |
| WO | 2010/016428 | A1 | 2/2010 |

OTHER PUBLICATIONS

U.S. Office Action issued on Nov. 6, 2014 in U.S. Appl. No. 13/254,382.

Varschaysky et al., Influence of microstructure on the subcritical crack growth in Cu—Co—Si alloys:, Congresso Annual—Associacao Brasiliera DeMetalurgia E Materials, vol. 2, pp. 503-510 (Jan. 1, 1995).

Office Action dated Feb. 25, 2014 for U.S. Appl. No. 13/254,382.

Office Action dated Jun. 2, 2014 for U.S. Appl. No. 13/254,382.

English Language machine translation of JP09-020943 to Fujiwara. Generated May 22, 2014.

Supplementary European Search Report dated Mar. 11, 2014 in European Application 11768802.8 (European phase of PCT/JP2011/058921).

U.S. Office Action issued on Apr. 23, 2015 in U.S. Appl. No. 13/254,382.

U.S. Office Action issued on Feb. 26, 2015 in U.S. Appl. No. 13/581,715.

U.S. Office Action issued on Jul. 6, 2015 in U.S. Appl. No. 13/581,715.

U.S. Office Action issued on Aug. 13, 2015 in U.S. Appl. No. 13/876,185.

* cited by examiner

CU—SI—CO ALLOY FOR ELECTRONIC MATERIALS, AND METHOD FOR PRODUCING SAME

TECHNICAL FIELD

The present invention relates to a precipitation hardened copper alloy, and more particularly, to a Cu—Si—Co alloy suitable for the use in various electronic components.

BACKGROUND ART

Copper alloys for electronic materials used in various electronic components such as connectors, switches, relays, pins, terminals and lead frames, are required to achieve a balance between high strength and high electrical conductivity (or thermal conductivity) as basic characteristics. In recent years, high integration, small and thin-type electronic components are in rapid progress, and in this respect, the demand for a copper alloy to be used in the components of electronic equipment is rising to higher levels.

From the viewpoints of high strength and high electrical conductivity, the amount of use of precipitation hardened copper alloys is increasing in replacement of conventional solid solution hardened copper alloys represented by phosphor bronze and brass, as copper alloys for electronic materials. In a precipitation hardened copper alloy, as a supersaturated solid solution that has been solution heat treated is subjected to an aging treatment, fine precipitates are uniformly dispersed, so that the strength of the alloy increases, the amount of solid-solution elements in copper decreases, and also, electrical conductivity increases. For this reason, a material having excellent mechanical properties such as strength and spring properties, and having satisfactory electrical conductivity and heat conductivity is obtained.

Among precipitation hardened copper alloys, Cu—Ni—Si alloys, which are generally referred to as Corson alloys, are representative copper alloys having relatively high electrical conductivity, strength and bending workability in combination, and constitute one class of alloys for which active development is currently underway in the industry. In this class of copper alloys, an enhancement of strength and electrical conductivity can be promoted by precipitating fine Ni—Si intermetallic compound particles in a copper matrix.

In order to obtain a Corson alloy which has high conductivity, strength and bending workability in combination and satisfies the requirements required in copper alloys for electronic materials of recent years, it is important to reduce the number of coarse second phase particles through appropriate compositions and production processes, and to control the grains to a uniform and appropriate particle size.

For such Corson alloys, in recent years, there has been an attempt to further enhance the characteristics thereof by adding Co.

Patent Literature 1 describes the following statements. Co forms a compound with Si similarly to Ni and increases mechanical strength. A Cu—Co—Si alloy is improved in terms of both mechanical strength and electrical conductivity when subjected to an aging treatment, as compared to a Cu—Ni—Si alloy. If it is allowable in view of cost, a Cu—Co—Si alloy may be chosen. Further, it is described that in order to suitably realize the characteristics, it is necessary that the grain size be adjusted to greater than 1 μm and less than or equal to 25 μm. The copper alloy described in Patent Literature 1 is produced by conducting, after cold working, a heat treatment for the purpose of recrystallization and a solution treatment, immediately conducting quenching, and conducting an aging treatment as necessary. It is described that it is desirable to perform a recrystallization treatment at 700° C. to 920° C. after cold working, and to perform cooling as rapidly as possible with a cooling rate of 10° C./s or greater, and that the aging treatment temperature is set to 420° C. to 550° C.

Patent Literature 2 describes a Cu—Co—Si alloy that has been developed for the purpose of realizing high strength, high electrical conductivity and high bending workability, and the copper alloy is characterized in that a compound of Co and Si and a compound of Co and P are present in the matrix phase, the average grain size of the matrix phase is 20 μm or less, and the aspect ratio of the sheet thickness direction to the rolling direction is 1 to 3. As a method for producing a copper alloy described in Patent Literature 2, a method of conducting cold rolling at a ratio of 85% or greater after hot rolling, annealing for 5 to 30 minutes at 450° C. to 480° C., conducting cold rolling at a ratio of 30% or less, and conducting an aging treatment at 450° C. to 500° C. for 30 minutes to 120 minutes, is described.

CITATION LIST

Patent Literature 1: Japanese Patent Application Laid-Open (JP-A) No. 11-222641

Patent Literature 2: JP-A No. 9-20943

SUMMARY OF INVENTION

Technical Problem

As such, it is known that addition of Co contributes to an enhancement of the characteristics of a copper alloy, but since investigation has been primarily concentrated on Cu—Ni—Si alloys among the Corson alloys, sufficient investigation has not been conducted on the improvement of the characteristics of Cu—Co—Si alloys.

Thus, it is an object of the present invention to provide a Cu—Co—Si alloy which has an improved balance between electrical conductivity and strength and preferably also has improved bending workability. Another object of the present invention is to provide a method for producing such a Cu—Co—Si alloy.

Solution to Problem

The inventors of the present invention conducted a thorough investigation in order to address the problems described above, and the inventors realized that in a Cu—Co—Si alloy, since the solid solubility limit is lower than that of Cu—Ni—Si alloys, second phase particles easily precipitate out. Furthermore, the inventors realized that in a Cu—Co—Si alloy, second phase particles are likely to be produced as a discontinuous precipitate (also referred to as a grain boundary reaction precipitate), and this exerts adverse influence on the alloy characteristics. It is speculated that one of the causes for this phenomenon is the larger difference in the atomic radius between Cu and Co, than the difference between Cu and Ni.

Thus, the inventors conducted an investigation on the control of the second phase particles, particularly the discontinuous precipitates, and the inventors found that it is important to make grains relatively coarse by allowing the alloy to mildly pass through the recrystallization temperature region at the time of cooling after hot rolling; to maintain the grains coarse until the solution treatment; to conduct cold rolling under low working ratio conditions or high working ratio conditions; and to employ production conditions in which an aging treatment is defined to be carried out at a relatively high temperature.

The present invention was accomplished based on the finding described above, and according to an aspect of the invention, there is provided a copper alloy for electronic materials, which contains 0.5% to 4.0% by mass of Co and 0.1% to 1.2% by mass of Si, with the balance being Cu and unavoidable impurities, and in which the mass % ratio of Co and Si (Co/Si) is $3.5 \leq Co/Si \leq 5.5$, the area ratio of discontinuous precipitation (DP) cells is 5% or less, and the average value of the maximum width of discontinuous precipitation (DP) cells is 2 μm or less.

According to an embodiment of the copper alloy for electronic materials related to the present invention, the density of continuous precipitates having a particle size of 1 μm or greater is 25 or fewer particles per 1000 $\mu m^2$ in a cross-section parallel to a rolling direction.

According to another embodiment of the copper alloy for electronic materials related to the present invention, the rate of decrease in 0.2% yield strength after heating for 30 minutes at a material temperature of 500° C. is 10% or less.

According to another embodiment of the copper alloy for electronic materials related to the present invention, when 90° bending work is carried out in a W bending test in a bad way under the conditions under which a ratio of the sheet thickness and the bending radius is 1, a surface roughness Ra at a bent area is 1 μm or less.

According to still another embodiment of the copper alloy for electronic materials related to the present invention, the average grain size in the cross-section parallel to the rolling direction is 10 μm to 30 μm.

According to still another embodiment of the copper alloy for electronic materials related to the present invention, the peak 0.2% yield strength (peak YS), the overaged 0.2% yield strength (overaged YS), and the difference between the peak YS and the overaged YS (ΔYS) satisfy the relation: ΔYS/peak YS ratio 5.0%. Here, the peak 0.2% yield strength (peak YS) is the highest 0.2% yield strength obtainable when an aging treatment is carried out by setting the aging treatment time to 30 hours and changing the aging treatment temperature by 25° C. each time; and the overaged 0.2% yield strength (overaged YS) is the 0.2% yield strength obtainable when the aging treatment temperature is set to a temperature higher by 25° C. than the aging treatment temperature at which the peak YS was obtained.

According to another embodiment of the copper alloy for electronic materials related to the present invention, the copper alloy further contains at least one alloying element selected from the group consisting of Cr, Sn, P, Mg, Mn, Ag, As, Sb, Be, B, Ti, Zr, Al, and Fe, and the total amount of the alloying elements is 2.0% by mass or less.

Furthermore, according to another aspect of the present invention, there is provided a method for producing the copper alloy for electronic materials related to the present invention, the method including:

step 1: melting and casting an ingot having a predetermined composition;

step 2: then, heating the material for one hour or longer at a material temperature of from 950° C. to 1070° C., and then performing hot rolling, provided that the average cooling rate employed for the period in which the material temperature decreases from 850° C. to 600° C. is set to equal to or greater than 0.4° C./s and less than or equal to 15° C./s, and the average cooling rate employed at or below 600° C. is set to 15° C./s or greater;

step 3: then, optionally repeating cold rolling and annealing, provided that in the case of performing an aging treatment for annealing, the aging treatment is carried out at a material temperature of 450° C. to 600° C. for 3 hours to 24 hours, and in the case of performing cold rolling immediately before the aging treatment, the working ratio is set to 40% or less or 70% or greater;

step 4: then, conducting a solution treatment, provided that the maximum arrival temperature of the material during the solution treatment is set to 900° C. to 1070° C., the time for which the material temperature is maintained at the maximum arrival temperature is set to 480 seconds or less, and the average cooling rate employed for the period in which the material temperature decreases from the maximum arrival temperature to 400° C. is set to 15° C./s or greater; and step 5: then, conducting an aging treatment, provided that in the case of performing cold rolling immediately before the aging treatment, the working ratio is set to 40% or less or 70% or greater.

According to an embodiment of the production method related to the present invention, the production method includes conducting any one of items (1) to (4') after the step 4:

(1) cold rolling→aging treatment (step 5)→cold rolling (1') cold rolling→aging treatment (step 5)→cold rolling→(low temperature aging treatment or stress relief annealing)

(2) cold rolling→aging treatment (step 5)

(2') cold rolling→aging treatment (step 5)→(low temperature aging treatment or stress relief annealing)

(3) aging treatment (step 5)→cold rolling (3') aging treatment (step 5)→cold rolling→(low temperature aging treatment or stress relief annealing)

(4) aging treatment (step 5)→cold rolling aging treatment (4') aging treatment (step 5)→cold rolling→aging treatment→(low temperature aging treatment or stress relief annealing), provided that the low temperature aging treatment is carried out at 300° C. to 500° C. for 1 hour to 30 hours.

Furthermore, according to another aspect of the present invention, there is provided a wrought copper product obtained by processing the copper alloy for electronic materials related to the present invention.

According to still another aspect of the present invention, there is provided an electronic component containing the copper alloy for electronic materials related to the present invention.

Advantageous Effects of Invention

According to the present invention, a Cu—Co—Si alloy which has an improved balance between strength and electrical conductivity and preferably also has improved bending workability, is obtained.

Furthermore, according to a preferred embodiment of the present invention, a Cu—Co—Si alloy in which heat resistance is improved, overage softening which occurs in the aging treatment is suppressed, and the fluctuation of strength due to the temperature difference in the material coil during the aging treatment is decreased, is obtained.

DESCRIPTION OF EMBODIMENTS

Composition

Figure 1:
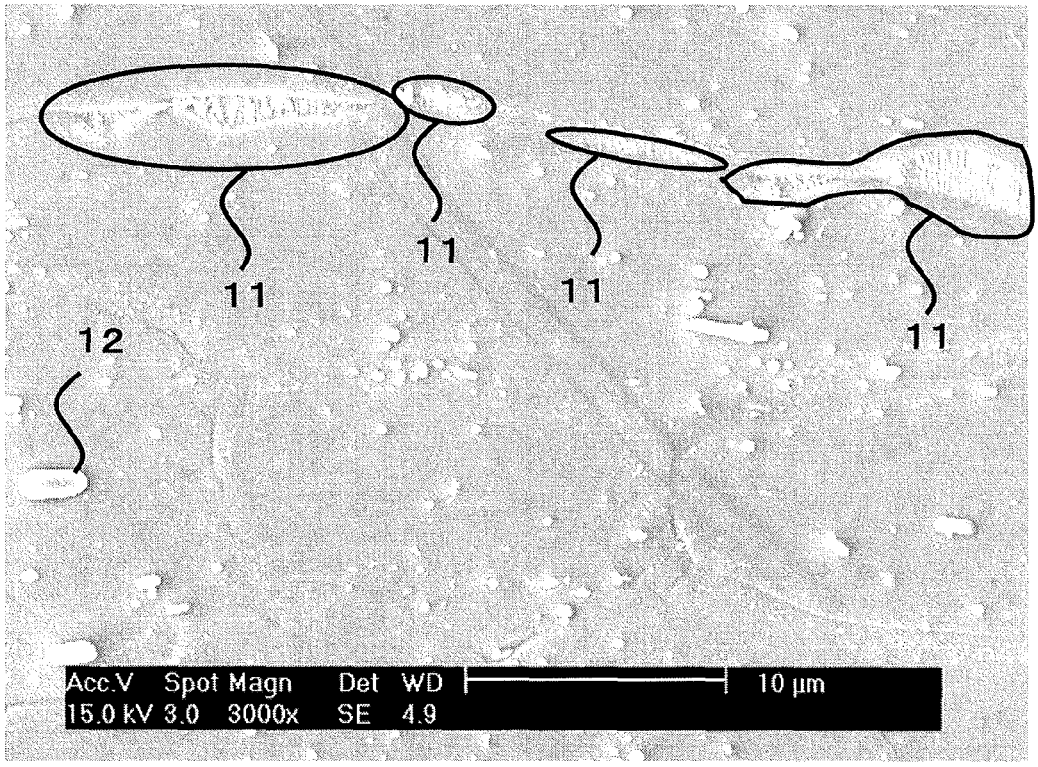
FIG. 1 is a photograph obtained by observing a Cu—Co—Si copper alloy with an electron microscope in order to explain the difference between discontinuous precipitation (DP) cells and continuous precipitates (magnification: 3000 times)

The copper alloy for electronic material according to the present invention contains 0.5% to 4.0% by mass of Co and 0.1% to 1.2% by mass of Si, with the balance being Cu and unavoidable impurities, and has a composition in which the mass % ratio of Co and Si (Co/Si) is 3.5≤Co/Si≤5.5.

With regard to Co, if the amount of addition is too small, the strength required as a material for electronic components such as connectors may not be obtained, and on the other hand, if the amount of addition is too large, a crystal phase is produced at the time of casting, causing casting cracks. Furthermore, a decrease in hot workability occurs, and hot rolling cracks are caused. Thus, the amount of addition of Co is set to 0.5% to 4.0% by mass. A preferred amount of addition of Co is 1.0% to 3.5% by mass.

If the amount of addition of Si is too small, the strength required as a material for electronic components such as connectors may not be obtained, and on the other hand, if the amount of addition is too large, a significant decrease in electrical conductivity occurs. Thus, the amount of addition of Si is set to 0.1% to 1.2% by mass. A preferred amount of addition of Si is 0.2% to 1.0% by mass.

In regard to the mass ratio of Co and Si (Co/Si), the composition of cobalt silicide that constitutes the second phase particles, which are directed to an increase in strength, is $Co_2Si$, and at a mass ratio of 4.2, the characteristics can be enhanced most efficiently. If the mass ratio of Co and Si is too distant from this value, any one of the elements may exist in excess; however, an excessive element is not connected to an increase in strength, and is rather directed to a decrease in electrical conductivity, which is inappropriate. Thus, in the present invention, the mass % ratio of Co and Si is adjusted to 3.5≤Co/Si≤5.5, and preferably 4≤Co/Si≤5.

When a predetermined amount of at least one element selected from the group consisting of Cr, Sn, P, Mg, Mn, Ag, As, Sb, Be, B, Ti, Zr, Al and Fe is added as another additive element, there is obtained an effect of improving strength, electrical conductivity, bending workability, platability, hot workability as a result of refinement of the ingot structure, or the like. The total amount of the alloying elements in this case is such that if the total amount is excessive, a decrease in electrical conductivity or deterioration of manufacturability occurs noticeably. Therefore, the total amount is at most 2.0% by mass, and preferably at most 1.5% by mass. On the other hand, in order to obtain a desired effect sufficiently, it is preferable to adjust the total amount of the alloying elements to 0.001% by mass or greater, and more preferably to 0.01% by mass or greater.

Furthermore, the content of the alloying elements is preferably adjusted to 0.5% by mass at the maximum for each of the alloying elements. It is because if the amount of addition of each of the alloying elements is greater than 0.5% by mass, not only the effects described above are not promoted to a further extent, but also the decrease in electrical conductivity or deterioration of manufacturability becomes noticeable.

Discontinuous Precipitation (DP) Cells

According to the present invention, a region in which second phase particles of cobalt silicide have been precipitated out in a layered form along the grain boundaries as a result of the grain boundary reaction, is called a discontinuous precipitation (DP) cell. According to the present invention, cobalt silicide refers to second phase particles containing 35% by mass or more of Co and 8% by mass or more of Si, and cobalt silicide can be measured by EDS (energy dispersive X-ray spectroscopy).

Figure 2:
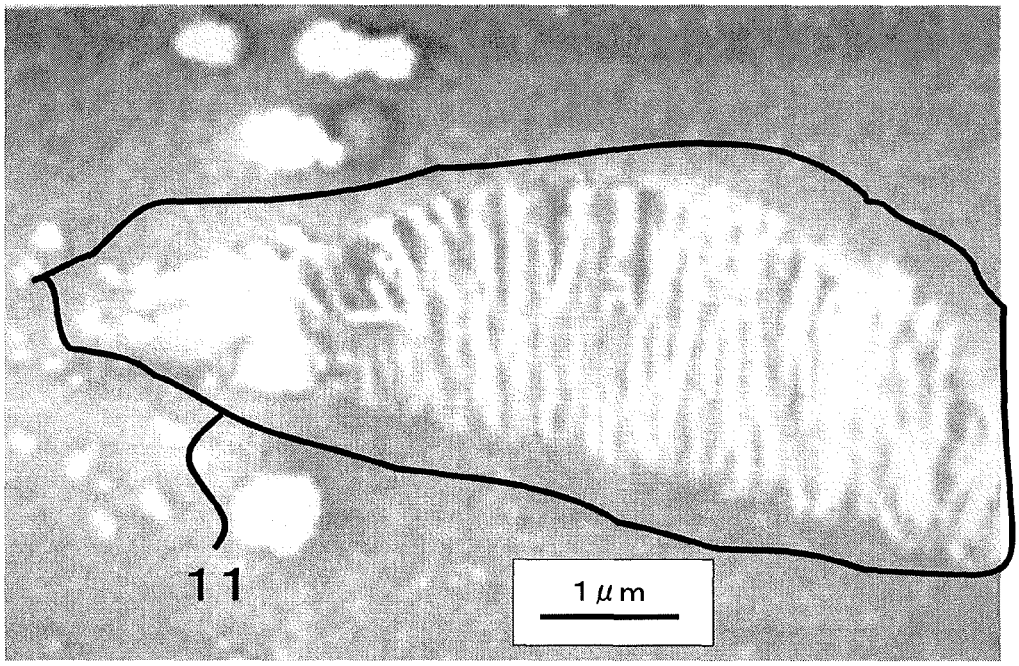
FIG. 2 is a photograph obtained by observing discontinuous precipitation (DP) cells of FIG. 1 under magnification (magnification: 15000 times).

Referring to FIG. 1 and FIG. 2, each one of the regions that form layer-shaped cells along the grain boundaries, is each discontinuous precipitation (DP) cell 11. Generally, in many cases, a cobalt silicide phase and a Cu matrix phase are in a layered form within the discontinuous precipitation (DP) cell. The layer spacing may vary in a wide range, but the layer spacing is generally 0.01 μm to 0.5 μm.

Discontinuous precipitation (DP) cells have adverse influence on the balance between strength and electrical conductivity, or on heat resistance, and accelerate overage softening. Therefore, it is desirable that the discontinuous precipitation cells do not exist as far as possible. Thus, in the present invention, the area ratio of the discontinuous precipitation (DP) cells is suppressed to 5% or less, and the average value of the maximum width of the discontinuous precipitation (DP) cells is suppressed to 2 μm or less. The area ratio of the discontinuous precipitation (DP) cells is preferably 4% or less, and more preferably 3% or less. However, if it is intended to completely eliminate discontinuous precipitation (DP) cells, it is necessary to increase the solution treatment temperature. In that case, since the grains tend to become larger, the area ratio of the discontinuous precipitation (DP) cells is preferably 1% or higher, and more preferably 2% or higher. The average value of the maximum width of the discontinuous precipitation (DP) cells is preferably 1.5 μm or less, and more preferably 1.0 μm or less. On the other hand, if it is intended to decrease the average value of the maximum width of the discontinuous precipitation (DP) cells, grains also definitely tend to become larger. Therefore, the average value of the maximum width is preferably 0.5 μm or greater, and more preferably 0.8 μm or greater. In view of obtaining a satisfactory balance between strength and electrical conductivity, it is necessary to control both the area ratio and the average value of the maximum width, and if only any one of them is controlled, the effect is restricted.

According to the present invention, the area ratio and the average value of the maximum width of the discontinuous precipitation (DP) cells are measured by the following methods.

A cross-section that is parallel to the rolling direction of a material is processed into a mirror-like surface by mechanical polishing by using diamond polishing particles having a diameter of 1 μm, and then the mirror-like surface is subjected to electrolytic polishing for 30 seconds in a 5% aqueous phosphoric acid solution at 20° C. at a voltage of 1.5 V. Through this electrolytic polishing, the matrix of Cu is dissolved, and the second phase particles remain undissolved and are exposed. This cross-section is observed at any arbitrary 10 sites by using an FE-SEM (field emission-scanning electron microscope) at a magnification of 3000 times (field of vision for observation: 30 μm×40 μm).

The area ratio is determined by dividing and coloring discontinuous precipitation (DP) cells and non-DP cell areas in two colors of white and black according to the definition given above, by using an imaging software, and calculating the area occupied by the discontinuous precipitation (DP)

cells in the field of vision for observation by an image analysis software. The average value of the values obtained at 10 sites is divided by the value of the area of the field of vision for observation (1200 $\mu m^2$), and the resultant value is designated as the area ratio.

The average value of the maximum width is obtained by determining, among the discontinuous precipitation (DP) cells observed, the largest length among the lengths in the directions perpendicular to the grain boundaries in various fields of vision for observation, and the average value obtained at such 10 sites is designated as the average value of the maximum width.

Continuous Precipitates

Continuous precipitates refer to the second phase particles that precipitate out within the grains. Among the continuous precipitates, continuous precipitates having a particle size of 1 μm or greater do not contribute to an enhancement of strength, and are also connected to deterioration of bending workability. Thus, the density of continuous precipitates having a particle size of 1 μm or greater is preferably 25 or fewer particles, more preferably 15 or fewer particles, and even more preferably 10 or fewer particles, per 1000 $\mu m^2$ in a cross-section parallel to the rolling direction. According to the present invention, the particle size of a continuous precipitate refers to the diameter of the smallest circle that circumscribes an individual continuous precipitate.

Grain Size

Grains affect strength, and since the Hall-Petch rule which states that strength is directly proportional to the power of −½ of the grain size, generally applies, smaller grains are preferred. However, as for a precipitation hardened alloy, there is a need to take note on the precipitation state of the second phase particles. During an aging treatment, fine second phase particles that have precipitated out inside the grains (continuous precipitates) contribute to an enhancement of strength, but the second phase particles that have precipitated out on the grain boundaries (discontinuous precipitates) hardly contribute to an enhancement of strength. Therefore, as the grains are smaller, the proportion of the grain boundary reaction in the precipitation reaction increases, and accordingly, grain boundary precipitation that does not contribute to an enhancement of strength becomes dominant. Thus, if the grain size is less than 10 μm, desired strength cannot be obtained. On the other hand, coarse grains deteriorate bending workability.

Thus, from the viewpoint of obtaining desired strength and bending workability, it is preferable to adjust the average grain size to 10 μm to 30 μm. Furthermore, from the viewpoint of achieving a balance between high strength and satisfactory bending workability, it is more preferable to control the average grain size to 10 μm to 20 μm.

Strength, Electrical Conductivity and Bending Workability

The Cu—Co—Si alloy according to the present invention is capable of achieving strength, electrical conductivity and bending workability to higher levels. According to an embodiment, a 0.2% yield strength (YS) of 800 MPa or greater, a bent surface mean roughness of 0.8 μm or less, and an electrical conductivity of 40% IACS or greater, preferably 45% IACS or greater, and more preferably 50% IACS or greater can be obtained. According to another embodiment, a 0.2% yield strength (YS) of 830 MPa or greater, a bent surface mean roughness of 0.8 μm or less, and an electrical conductivity of 45% IACS or greater, and preferably 50% IACS or greater can be obtained. According to still another embodiment, a 0.2% yield strength (YS) of 860 MPa or greater, a bent surface mean roughness of 1.0 μm or less, and an electrical conductivity of 45% IACS or greater, and preferably 50% IACS or greater can be obtained.

Resistance to Overage Softening

The Cu—Co—Si alloy according to the present invention has a feature that the alloy is resistant to overage softening since the formation of discontinuous precipitation (DP) cells is suppressed. Due to this feature, the fluctuation in strength caused by a fluctuation in the temperature conditions at the time of aging treatment can be reduced. Furthermore, in the case of a batch type aging treatment of treating the material in a coil form, a temperature difference of about 10° C. to 25° C. occurs between the outer periphery and the center of the coil. The Cu—Co—Si alloy according to the present invention can decrease the fluctuation in strength that is caused by the temperature difference between the outer periphery and the center of the coil. In other words, it can be said that the Cu—Co—Si alloy according to the present invention has excellent production stability during an aging treatment.

According to a preferred embodiment, the copper alloy related to the present invention has a feature that the copper alloy is resistant to overage softening. It is speculated that this is attributable to the fact that discontinuous precipitates are suppressed. The resistance to overage softening can be evaluated, in the case of stress relief annealed or cold rolling finished products, by subjecting the products to an aging treatment. On the other hand, in the case of (low temperature) aging treatment finished products, the resistance to overage softening cannot be evaluated by subjecting the products to an aging treatment; however, evaluation can be carried out at the same time when the (low temperature) aging treatment is carried out.

In the present invention, the value of ΔYS/peak YS is used as an evaluation index for the non-susceptibility to overage softening. The term YS represents the 0.2% yield strength. Furthermore, the peak YS is the highest value of YS when an aging treatment is carried out by setting the aging treatment time to 30 hours and changing the aging treatment temperature by 25° C. each time. Furthermore, the 0.2% yield strength obtainable when the aging treatment temperature is higher by 25° C. than the aging treatment temperature at which the peak YS has been obtained, is designated as the overaged YS.

ΔYS is defined as follows:

$$\Delta YS = (\text{peak } YS) - (\text{overaged } YS)$$

Furthermore, the ratio of ΔYS/peak YS is defined as follows:

$$\Delta YS/\text{peak } YS = \Delta YS/\text{peak } YS \times 100(\%)$$

That is, when the value of ΔYS/peak YS is small, it means that overage softening is not likely to occur. According to an embodiment, the value of ΔYS/peak YS may be 5.0% or less, preferably 4.0% or less, more preferably 3.0% or less, and most preferably 2.5% or less.

According to a preferred embodiment, the Cu—Co—Si alloy related to the present invention also has excellent bending workability. When 90° bending work is carried out in a W bending test in a bad way under the conditions under which the ratio of the sheet thickness and the bending radius is 1, the surface roughness Ra at the bent area as measured according to JIS B0601 can be adjusted to 1 μm or less, and further can be adjusted to 0.7 μm or less.

According to a preferred embodiment, the copper alloy for electronic materials related to the present invention can suppress the softening caused by the growth of discontinuous precipitates, and therefore, the copper alloy has excellent heat resistance. Also, the rate of decrease in the 0.2% yield strength after heating for 30 minutes at a material temperature of 500° C. can be adjusted to 10% or less, preferably 8% or less, and more preferably 7% or less.

According to a preferred embodiment, the copper alloy for electronic materials related to the present invention can suppress the softening caused by the growth of discontinuous precipitates, and therefore, overage softening is suppressed during an aging treatment, and the fluctuation in strength due to the temperature difference in a material coil during the aging treatment can be reduced. Specifically, when the copper alloy is subjected to an aging treatment for 30 hours at a temperature higher by 25° C. than the peak aging treatment temperature, the rate of decrease in the 0.2% yield strength can be adjusted to 5% or less, preferably 4.0% or less, more preferably 3% or less, and most preferably 2.5% or less.

Production Method

The fundamental process for producing the Cu—Co—Si alloy according to the present invention includes melting and casting an ingot having a predetermined composition, conducting hot rolling, and then appropriately repeating cold rolling and annealing (including aging treatments and recrystallization annealing). Thereafter, a solution treatment and an aging treatment are carried out under predetermined conditions. After the aging treatment, stress relief annealing may be further carried out. Cold rolling may also be inserted before and after the heat treatments as necessary. While it is noted that discontinuous precipitation is suppressed when the grains are coarser, the aging treatment is conducted at a higher temperature, and the working ratio at the time of cold rolling is a lower working ratio or a higher working ratio, the conditions for the various processes should be determined. Suitable conditions for the following various processes will be described.

Since coarse crystals are unavoidably produced in the solidification process at the time of casting, and coarse precipitates are unavoidably produced in the cooling process, it is necessary to solid-solubilize these coarse crystals/precipitates in the matrix phase in the subsequent processes. Therefore, it is preferable to perform hot rolling after heating the alloy to a material temperature of 950° C. to 1070° C. for one hour or longer, and preferably for 3 hours to 10 hours in order to form a more homogeneous solid solution. A temperature condition of 950° C. or higher is a high temperature setting as compared with the case of other Corson alloys. If the retention temperature before hot rolling is lower than 950° C., solid solution occurs insufficiently, and if the retention temperature is higher than 1070° C., there is a possibility that the material may melt.

At the time of hot rolling, if the material temperature is lower than 600° C., since precipitation of solid-solubilized elements occurs noticeably, it is difficult to obtain high strength. Furthermore, in order to achieve homogeneous recrystallization, it is preferable to set the temperature at the time of completion of hot rolling to 850° C. or higher. Therefore, it is preferable to bring the material temperature at the time of hot rolling in the range of 600° C. to 1070° C., and it is more preferable to set the material temperature in the range of 850° C. to 1070° C.

During hot rolling, regardless of whether it is in the middle of rolling or in the middle of cooling after rolling, for the purpose of achieving coarse recrystallization by mildly cooling the material in order to suppress discontinuous precipitation, it is preferable to adjust the average cooling rate for the period in which the material temperature decreases from 850° C. to 600° C., to 15° C./s or less, and more preferably to 10° C./s or less. However, if the cooling rate is too slow, coarsened second phase particles containing the continuous form and the discontinuous form precipitate out in this case. Therefore, it is preferable to adjust the cooling rate to 0.4° C./s or greater, more preferably to 1° C./s or greater, and more preferably to 3° C./s or greater. Attention has been paid to the average cooling rate at the temperatures from 850° C. to 600° C. because recrystallization occurs significantly in this temperature range. The cooling rate in this temperature range can be controlled, in the case of performing cooling in the atmosphere, by blowing a cooling gas such as air, and changing the temperature and flow rate of the cooling gas. Furthermore, in the case of performing cooling in a furnace, the cooling rate can be controlled by regulating the temperature in the furnace, and the flow rate and temperature of the gas in the furnace.

The average cooling rate as used herein is defined as follows:

Average cooling rate(° C./*s*)=(850−600(° C.))/(time required to decrease from 850° C. to 600° C.(*s*))

After the material is cooled to 600° C., it is preferable to perform cooling as rapidly as possible in order to suppress the precipitation of second phase particles. Specifically, it is preferable to adjust the average cooling rate at or below 600° C. to 15° C./s or greater, and more preferably to 50° C./s or greater. Cooling in this case is generally carried out by water cooling, and the cooling rate can be controlled by regulating the amount of water or water temperature.

The average cooling rate in this case is defined as follows:

Average cooling rate(° C./*s*)=(600−100(° C.))/(time required to decrease from 600° C. to 100° C.(*s*))

After hot rolling, it is desirable to appropriately repeat annealing (including an aging treatment and recrystallization annealing) and cold rolling before the solution treatment. However, it is preferable to perform cold rolling immediately before the aging treatment at a high working ratio or at a low working ratio, in order to suppress discontinuous precipitation. Specifically, it is preferable to adjust the working ratio to less than or equal to 40%, or to equal to or greater than 70%, and it is more preferable to adjust the working ratio to less than or equal to 30%, or to equal to or greater than 80%. If the working ratio is too low, the number of times of annealing and cold rolling increases, and the time required for the production increases. If the working ratio is too high, it takes time for cold rolling due to process hardening, and the load applied to the rolling machine increases so that the rolling machine is prone to break down. Therefore, the working ratio is typically 5% to 30%, or 70% to 95%. The working ratio is defined by the following formula:

Working ratio(%)=(Sheet thickness before rolling−sheet thickness after rolling)/sheet thickness before rolling×100

Further, in the case of conducting an aging treatment, it is desirable to suppress discontinuous precipitation by conducting the aging treatment by heating at a relatively high temperature. However, if the temperature is excessively high, overaging occurs, precipitates grow large, and a solid solution does not form easily, which is inconvenient. Thus, it is preferable to perform annealing at a material temperature of 450° C. to 600° C. for 3 hours to 24 hours, and it is more preferable to perform annealing at a material temperature of 475° C. to 550° C. for 6 hours to 20 hours.

Incidentally, in the case of performing not an aging treatment but recrystallization annealing, it is not necessary to pay special attention to the cold rolling working ratio in the subsequent process. It is because since recrystallization annealing is usually carried out at a high temperature of 750° C. or higher, discontinuous precipitation does not matter.

In a solution treatment, it is important to reduce the number of coarse second phase particles containing the continuous form and the discontinuous form through sufficient solid solution, and to prevent grain coarsening. Thus, the maximum arrival temperature of the material in the solution treatment is set to 900° C. to 1070° C. If the maximum arrival temperature is lower than 900° C., a solid solution is not obtained sufficiently, and coarse second phase particles remain behind. Therefore, desired strength and bending workability cannot be obtained. From the viewpoint of obtaining high strength, it is preferable that the maximum arrival temperature be high, and specifically, it is preferable to set the maximum arrival temperature to 1020° C. or higher, and more preferably to 1040° C. or higher. However, if the maximum arrival temperature is higher than 1070° C., the grains become noticeably coarse, and an enhancement of strength cannot be expected. Also, since that temperature is close to the melting point of copper, this becomes a bottleneck in production.

Furthermore, the time appropriate for the material temperature to be maintained at the maximum arrival temperature may vary depending on the Co and Si concentrations and the maximum arrival temperature. However, in order to prevent the coarsening of grains caused by recrystallization and the subsequent growth of grains, the time for the material temperature to be maintained at the maximum arrival temperature is controlled typically to 480 seconds or less, preferably 240 seconds or less, and more preferably 120 seconds or less. However, if the time for the material temperature to be maintained at the maximum arrival temperature is too short, the number of coarse second phase particles may not be reduced. Therefore, it is preferable to set the time to 10 seconds or longer, and more preferably to 20 seconds or longer.

Furthermore, from the viewpoint of preventing the precipitation of second phase particles or the coarsening of recrystallized grains, it is preferable that the cooling rate after the solution treatment be as high as possible. Specifically, it is preferable to adjust the average cooling rate at the time when the material temperature decreases from the maximum arrival temperature to 400° C., to 15° C./s or greater, and more preferably to 50° C./s or greater. Cooling in this case is generally carried out by blowing a cooling gas, or by water cooling. In the cooling by blowing a cooling gas, the cooling rate can be controlled by adjusting the temperature in the furnace, and the temperature or flow rate of the cooling gas. In the cooling by water cooling, the cooling rate can be controlled by regulating the amount of water or the water temperature. Attention has been paid to the average cooling rate of from the maximum arrival temperature to 400° C. in terms of preventing the precipitation of second phase particles or the coarsening of recrystallized grains.

The average cooling rate in this case is defined as follows:

Average cooling rate(° C./*s*)=(Maximum arrival temperature−400 (° C.))/(time required from the time point of material take-out (the time point where the material temperature starts to decrease from the maximum arrival temperature) to the time point for the temperature to reach 400° C.(*s*))

After the solution treatment process, an aging treatment is carried out. Cold rolling may also be carried out before or after the aging treatment, or before and after the aging treatment, or another aging treatment may also be carried out after cold rolling. In the case of performing cold rolling immediately before the aging treatment, it is preferable to perform cold rolling under the conditions set forth earlier in order to suppress discontinuous precipitation. For the conditions of the aging treatment, temperature and time that are publicly known to allow fine uniform precipitation of continuous precipitates containing cobalt silicide, may be employed. An example of the conditions for the aging treatment is 1 hour to 30 hours at a temperature in the range of 350° C. to 600° C., and more preferably 1 hour to 30 hours at a temperature in the range of 425° C. to 600° C.

After the aging treatment, cold rolling and stress relief annealing or a low temperature aging treatment are carried out as necessary. In the case of performing cold rolling, it is preferable to perform cold rolling under the conditions set forth earlier in order to suppress discontinuous precipitation. In the case of performing stress relief annealing or a low temperature aging treatment after the cold rolling process, conventional conditions will be sufficient for the heating conditions. In the case of stress relief annealing intended to relieve the strain introduced by rolling, for example, stress relief annealing can be carried out at a temperature in the range of 300° C. to 600° C. for a time period of 10 seconds to 10 minutes. Furthermore, in the case of a low temperature aging treatment intended for an increase in strength and electrical conductivity caused by aging precipitation, for example, the low temperature aging treatment can be carried out at a temperature in the range of 300° C. to 500° C. for a time period of 1 hour to 30 hours.

Therefore, for example the following steps can be carried out after the solution treatment.

(1) Cold rolling→aging treatment→cold rolling→(low temperature aging treatment or stress relief annealing as necessary)

(2) Cold rolling→aging treatment→(low temperature aging treatment or stress relief annealing as necessary)

(3) Aging treatment→cold rolling→(low temperature aging treatment or stress relief annealing as necessary)

(4) Aging treatment→cold rolling→aging treatment→(low temperature aging treatment or stress relief annealing as necessary)

The Cu—Si—Co alloy of the present invention can be processed into various wrought copper products, for example, sheets, strips, pipes, rods, and wires. Furthermore, the Cu—Si—Co copper alloy according to the present invention can be used in electronic components such as lead frames, connectors, pins, terminals, relays, switches, and foil materials for secondary batteries.

EXAMPLES

Hereinafter, Examples of the present invention will be described together with Comparative Examples. However, these Examples are provided for the purpose of helping better understanding of the present invention and advantages thereof, and are not intended to limit the invention.

Table 1 presents the component compositions of the copper alloys used in Examples and Comparative Examples.

TABLE 1

| | Process | Co mass % | Si mass % | Co/Si ratio | Other additive elements mass % | Cu and unavoidable impurities |
|---|---|---|---|---|---|---|
| Invention Example No. | | | | | | |
| 1-1 | A1 | 1.5 | 0.35 | 4.3 | 0.0 | Balance |
| 1-2 | A8 | | | | | |
| 1-3 | A3 | | | | | |
| 1-4 | A2 | | | | | |
| 1-5 | A9 | | | | | |
| 1-6 | A10 | | | | | |
| 1-7 | A5 | | | | | |
| 1-8 | A4 | | | | | |
| 1-9 | A6 | | | | | |
| 1-10 | A7 | | | | | |
| 1-11 | A11 | | | | | |
| 1-12 | A12 | | | | | |
| 1-13 | A13 | | | | | |
| 1-14 | A14 | | | | | |
| 1-15 | A15 | | | | | |
| 1-16 | A16 | | | | | |
| 1-17 | A17 | | | | | |
| 1-18 | A18 | | | | | |
| 1-19 | A19 | | | | | |
| 1-20 | A20 | | | | | |
| 2-1 | A1 | 3.0 | 0.71 | 4.2 | 0.0 | Balance |
| 2-2 | A8 | | | | | |
| 2-3 | A3 | | | | | |
| 2-4 | A2 | | | | | |
| 2-5 | A9 | | | | | |
| 2-6 | A10 | | | | | |
| 2-7 | A5 | | | | | |
| 2-8 | A4 | | | | | |
| 2-9 | A6 | | | | | |
| 2-10 | A7 | | | | | |
| 2-11 | A11 | | | | | |
| 2-12 | A12 | | | | | |
| 2-13 | A13 | | | | | |
| 2-14 | A14 | | | | | |
| 2-15 | A15 | | | | | |
| 2-16 | A16 | | | | | |
| 2-17 | A17 | | | | | |
| 2-18 | A18 | | | | | |
| 2-19 | A19 | | | | | |
| 2-20 | A20 | | | | | |
| 3-1 | A1 | 3.0 | 0.71 | 4.2 | 0.1Mg | Balance |
| 3-2 | A8 | | | | | |
| 3-3 | A3 | | | | | |
| 3-4 | A2 | | | | | |
| 3-5 | A9 | | | | | |
| 3-6 | A10 | | | | | |
| 3-7 | A5 | | | | | |
| 3-8 | A4 | | | | | |
| 3-9 | A6 | | | | | |
| 3-10 | A7 | | | | | |
| 3-11 | A11 | | | | | |
| 3-12 | A12 | | | | | |
| 3-13 | A13 | | | | | |
| 3-14 | A14 | | | | | |
| 4-1 | A1 | 3.0 | 0.71 | 4.2 | 0.1Cr | Balance |
| 4-2 | A8 | | | | | |
| 4-3 | A3 | | | | | |
| 4-4 | A2 | | | | | |
| 4-5 | A9 | | | | | |
| 4-6 | A10 | | | | | |
| 4-7 | A5 | | | | | |
| 4-8 | A4 | | | | | |
| 4-9 | A6 | | | | | |
| 4-10 | A7 | | | | | |
| 4-11 | A11 | | | | | |
| 4-12 | A12 | | | | | |
| 4-13 | A13 | | | | | |
| 4-14 | A14 | | | | | |
| 5-1 | A1 | 3.0 | 0.71 | 4.2 | 0.1Sn | Balance |
| 5-2 | A8 | | | | | |
| 5-3 | A3 | | | | | |
| 5-4 | A2 | | | | | |

TABLE 1-continued

| | Process | Co mass % | Si mass % | Co/Si ratio | Other additive elements mass % | Cu and unavoidable impurities |
|---|---|---|---|---|---|---|
| 5-5 | A9 | | | | | |
| 5-6 | A10 | | | | | |
| 5-7 | A5 | | | | | |
| 5-8 | A4 | | | | | |
| 5-9 | A6 | | | | | |
| 5-10 | A7 | | | | | |
| 5-11 | A11 | | | | | |
| 5-12 | A12 | | | | | |
| 5-13 | A13 | | | | | |
| 5-14 | A14 | | | | | |
| 6-1 | A1 | 3.0 | 0.71 | 4.2 | 0.1P | Balance |
| 6-2 | A8 | | | | | |
| 6-3 | A3 | | | | | |
| 6-4 | A2 | | | | | |
| 6-5 | A9 | | | | | |
| 6-6 | A10 | | | | | |
| 6-7 | A5 | | | | | |
| 6-8 | A4 | | | | | |
| 6-9 | A6 | | | | | |
| 6-10 | A7 | | | | | |
| 6-11 | A11 | | | | | |
| 6-12 | A12 | | | | | |
| 6-13 | A13 | | | | | |
| 6-14 | A14 | | | | | |
| 7-1 | A1 | 3.0 | 0.71 | 4.2 | 0.1Mn | Balance |
| 7-2 | A8 | | | | | |
| 7-3 | A3 | | | | | |
| 7-4 | A2 | | | | | |
| 7-5 | A9 | | | | | |
| 7-6 | A10 | | | | | |
| 7-7 | A5 | | | | | |
| 7-8 | A4 | | | | | |
| 7-9 | A6 | | | | | |
| 7-10 | A7 | | | | | |
| 7-11 | A11 | | | | | |
| 7-12 | A12 | | | | | |
| 7-13 | A13 | | | | | |
| 7-14 | A14 | | | | | |
| 8-1 | A1 | 3.0 | 0.71 | 4.2 | 0.1Ag | Balance |
| 8-2 | A8 | | | | | |
| 8-3 | A3 | | | | | |
| 8-4 | A2 | | | | | |
| 8-5 | A9 | | | | | |
| 8-6 | A10 | | | | | |
| 8-7 | A5 | | | | | |
| 8-8 | A4 | | | | | |
| 8-9 | A6 | | | | | |
| 8-10 | A7 | | | | | |
| 8-11 | A11 | | | | | |
| 8-12 | A12 | | | | | |
| 8-13 | A13 | | | | | |
| 8-14 | A14 | | | | | |
| 9-1 | A1 | 3.0 | 0.71 | 4.2 | 0.1As | Balance |
| 9-2 | A8 | | | | | |
| 9-3 | A3 | | | | | |
| 9-4 | A2 | | | | | |
| 9-5 | A9 | | | | | |
| 9-6 | A10 | | | | | |
| 9-7 | A5 | | | | | |
| 9-8 | A4 | | | | | |
| 9-9 | A6 | | | | | |
| 9-10 | A7 | | | | | |
| 9-11 | A11 | | | | | |
| 9-12 | A12 | | | | | |
| 9-13 | A13 | | | | | |
| 9-14 | A14 | | | | | |
| 10-1 | A1 | 3.0 | 0.71 | 4.2 | 0.1Sb | Balance |
| 10-2 | A8 | | | | | |
| 10-3 | A3 | | | | | |
| 10-4 | A2 | | | | | |
| 10-5 | A9 | | | | | |
| 10-6 | A10 | | | | | |
| 10-7 | A5 | | | | | |
| 10-8 | A4 | | | | | |
| 10-9 | A6 | | | | | |

TABLE 1-continued

| | Process | Co mass % | Si mass % | Co/Si ratio | Other additive elements mass % | Cu and unavoidable impurities |
|---|---|---|---|---|---|---|
| 10-10 | A7 | | | | | |
| 10-11 | A11 | | | | | |
| 10-12 | A12 | | | | | |
| 10-13 | A13 | | | | | |
| 10-14 | A14 | | | | | |
| 11-1 | A1 | 3.0 | 0.71 | 4.2 | 0.1Be | Balance |
| 11-2 | A8 | | | | | |
| 11-3 | A3 | | | | | |
| 11-4 | A2 | | | | | |
| 11-5 | A9 | | | | | |
| 11-6 | A10 | | | | | |
| 11-7 | A5 | | | | | |
| 11-8 | A4 | | | | | |
| 11-9 | A6 | | | | | |
| 11-10 | A7 | | | | | |
| 11-11 | A11 | | | | | |
| 11-12 | A12 | | | | | |
| 11-13 | A13 | | | | | |
| 11-14 | A14 | | | | | |
| 12-1 | A1 | 3.0 | 0.71 | 4.2 | 0.1B | Balance |
| 12-2 | A8 | | | | | |
| 12-3 | A3 | | | | | |
| 12-4 | A2 | | | | | |
| 12-5 | A9 | | | | | |
| 12-6 | A10 | | | | | |
| 12-7 | A5 | | | | | |
| 12-8 | A4 | | | | | |
| 12-9 | A6 | | | | | |
| 12-10 | A7 | | | | | |
| 12-11 | A11 | | | | | |
| 12-12 | A12 | | | | | |
| 12-13 | A13 | | | | | |
| 12-14 | A14 | | | | | |
| 13-1 | A1 | 3.0 | 0.71 | 4.2 | 0.1Ti | Balance |
| 13-2 | A8 | | | | | |
| 13-3 | A3 | | | | | |
| 13-4 | A2 | | | | | |
| 13-5 | A9 | | | | | |
| 13-6 | A10 | | | | | |
| 13-7 | A5 | | | | | |
| 13-8 | A4 | | | | | |
| 13-9 | A6 | | | | | |
| 13-10 | A7 | | | | | |
| 13-11 | A11 | | | | | |
| 13-12 | A12 | | | | | |
| 13-13 | A13 | | | | | |
| 13-14 | A14 | | | | | |
| 14-1 | A1 | 3.0 | 0.71 | 4.2 | 0.1Al | Balance |
| 14-2 | A8 | | | | | |
| 14-3 | A3 | | | | | |
| 14-4 | A2 | | | | | |
| 14-5 | A9 | | | | | |
| 14-6 | A10 | | | | | |
| 14-7 | A5 | | | | | |
| 14-8 | A4 | | | | | |
| 14-9 | A6 | | | | | |
| 14-10 | A7 | | | | | |
| 14-11 | A11 | | | | | |
| 14-12 | A12 | | | | | |
| 14-13 | A13 | | | | | |
| 14-14 | A14 | | | | | |
| 15-1 | A1 | 3.0 | 0.71 | 4.2 | 0.1Fe | Balance |
| 15-2 | A8 | | | | | |
| 15-3 | A3 | | | | | |
| 15-4 | A2 | | | | | |
| 15-5 | A9 | | | | | |
| 15-6 | A10 | | | | | |
| 15-7 | A5 | | | | | |
| 15-8 | A4 | | | | | |
| 15-9 | A6 | | | | | |
| 15-10 | A7 | | | | | |
| 15-11 | A11 | | | | | |
| 15-12 | A12 | | | | | |
| 15-13 | A13 | | | | | |
| 15-14 | A14 | | | | | |

TABLE 1-continued

| | Process | Co mass % | Si mass % | Co/Si ratio | Other additive elements mass % | Cu and unavoidable impurities |
|---|---|---|---|---|---|---|
| 16-1 | A1 | 1.0 | 0.24 | 4.2 | 0.0 | Balance |
| 16-2 | A8 | | | | | |
| 16-3 | A3 | | | | | |
| 16-4 | A2 | | | | | |
| 16-5 | A9 | | | | | |
| 16-6 | A10 | | | | | |
| 16-7 | A5 | | | | | |
| 16-8 | A4 | | | | | |
| 16-9 | A6 | | | | | |
| 16-10 | A7 | | | | | |
| 16-11 | A11 | | | | | |
| 16-12 | A12 | | | | | |
| 16-13 | A13 | | | | | |
| 16-14 | A14 | | | | | |
| 16-15 | A15 | | | | | |
| 16-16 | A16 | | | | | |
| 16-17 | A17 | | | | | |
| 16-18 | A18 | | | | | |
| 16-19 | A19 | | | | | |
| 16-20 | A20 | | | | | |
| 17-1 | A1 | 4.0 | 0.95 | 4.2 | 0.0 | Balance |
| 17-2 | A8 | | | | | |
| 17-3 | A3 | | | | | |
| 17-4 | A2 | | | | | |
| 17-5 | A9 | | | | | |
| 17-6 | A10 | | | | | |
| 17-7 | A5 | | | | | |
| 17-8 | A4 | | | | | |
| 17-9 | A6 | | | | | |
| 17-10 | A7 | | | | | |
| 17-11 | A11 | | | | | |
| 17-12 | A12 | | | | | |
| 17-13 | A13 | | | | | |
| 17-14 | A14 | | | | | |
| 17-15 | A15 | | | | | |
| 17-16 | A16 | | | | | |
| 17-17 | A17 | | | | | |
| 17-18 | A18 | | | | | |
| 17-19 | A19 | | | | | |
| 17-20 | A20 | | | | | |
| Comparative Example No. | | | | | | |
| 1-21 | F | 1.5 | 0.35 | 4.3 | 0.0 | Balance |
| 1-22 | C | | | | | |
| 1-23 | B | | | | | |
| 1-24 | G | | | | | |
| 1-25 | H | | | | | |
| 1-26 | D | | | | | |
| 1-27 | E | | | | | |
| 1-28 | I | | | | | |
| 1-29 | J | | | | | |
| 2-21 | F | 3.0 | 0.71 | 4.2 | 0.0 | Balance |
| 2-22 | C | | | | | |
| 2-23 | B | | | | | |
| 2-24 | G | | | | | |
| 2-25 | H | | | | | |
| 2-26 | D | | | | | |
| 2-27 | E | | | | | |
| 2-28 | I | | | | | |
| 2-29 | J | | | | | |
| 3-15 | F | 3.0 | 0.71 | 4.2 | 0.1Mg | Balance |
| 3-16 | C | | | | | |
| 3-17 | B | | | | | |
| 3-18 | G | | | | | |
| 3-19 | H | | | | | |
| 3-20 | D | | | | | |
| 3-21 | E | | | | | |
| 4-15 | F | 3.0 | 0.71 | 4.2 | 0.1Cr | Balance |
| 4-16 | C | | | | | |
| 4-17 | B | | | | | |
| 4-18 | G | | | | | |
| 4-19 | H | | | | | |
| 4-20 | D | | | | | |
| 4-21 | E | | | | | |

TABLE 1-continued

| | Process | Co mass % | Si mass % | Co/Si ratio | Other additive elements mass % | Cu and unavoidable impurities |
|---|---|---|---|---|---|---|
| 5-15 | F | 3.0 | 0.71 | 4.2 | 0.1Sn | Balance |
| 5-16 | C | | | | | |
| 5-17 | B | | | | | |
| 5-18 | G | | | | | |
| 5-19 | H | | | | | |
| 5-20 | D | | | | | |
| 5-21 | E | | | | | |
| 16-21 | F | 1.0 | 0.24 | 4.2 | 0.0 | Balance |
| 16-22 | C | | | | | |
| 16-23 | B | | | | | |
| 16-24 | G | | | | | |
| 16-25 | H | | | | | |
| 16-26 | D | | | | | |
| 16-27 | E | | | | | |
| 16-28 | I | | | | | |
| 16-29 | J | | | | | |
| 17-21 | F | 4.0 | 0.95 | 4.2 | 0.0 | Balance |
| 17-22 | C | | | | | |
| 17-23 | B | | | | | |
| 17-24 | G | | | | | |
| 17-25 | H | | | | | |
| 17-26 | D | | | | | |
| 17-27 | E | | | | | |
| 17-28 | I | | | | | |
| 17-29 | J | | | | | |
| 18-1 | A1 | 0.2 | 0.05 | 4.2 | 0.0 | Balance |
| 19-1 | A1 | 4.5 | 1.07 | 4.2 | | |
| 20-1 | A1 | 1.5 | 0.23 | 6.5 | | |
| 21-1 | A1 | 1.5 | 0.60 | 2.5 | | |

Cu—Co—Si copper alloys having the compositions described above were produced under the production conditions of A1 to A20 (Invention Examples) and B to J (Comparative Examples) described in Table 2. All of the copper alloys were produced according to the following basic production processes.

A copper alloy having a predetermined composition was melted at 1300° C. by using a high frequency melting furnace and was cast into an ingot having a thickness of 30 mm.

Subsequently, this ingot was heated to 1000° C. and maintained for 3 hours, and then the ingot was subjected to hot rolling to obtain a sheet thickness of 10 mm. The material temperature at the time of completion of hot rolling was 850° C. The cooling conditions after the completion of hot rolling were as described in Table 2. Cooling was carried out in the furnace, and the control of the average cooling rate to 600° C. was achieved by regulating the temperature in the furnace or the cooling gas flow rate and the cooling gas temperature.

Subsequently, first cold rolling was carried out at the working ratio described in Table 2.

Subsequently, a first aging treatment was carried out under the conditions of the material temperature and the heating time described in Table 2.

Subsequently, second cold rolling was carried out at the working ratio described in Table 2.

Subsequently, a solution treatment was carried out under the conditions of the material temperature and the heating time described in Table 2. Cooling was carried out in the furnace, and the control of the average cooling rate to 400° C. was achieved by regulating the temperature in the furnace or the cooling gas flow rate and the cooling gas temperature.

Subsequently, third cold rolling was carried out at the working ratio described in Table 2.

Subsequently, a second aging treatment was carried out under the conditions of the material temperature and the heating time described in Table 2.

Subsequently, fourth cold rolling was carried out under the conditions described in Table 2.

Lastly, stress relief annealing or a low temperature aging treatment was carried out under the conditions described in Table 2, and the resultant was used as a specimen.

Further, surface milling, acid pickling and degreasing were carried out between each step as necessary.

TABLE 2-1

| Process | Example | | | | | | | | | |
|---|---|---|---|---|---|---|---|---|---|---|
| Melting | A1 | A2 | A3 | A4 | A5 | A6 | A7 | A8 | A9 | A10 |
| Hot rolling | Average cooling rate from 850° C. to 600° C.: 5° C./s Water cooling after reaching 600° C. Average cooling rate at or below 600° C.: 100° C./s | Same as A1 | Same as A1 | Same as A1 | Same as A1 | Same as A1 | Same as A1 | Same as A1 | Average cooling rate from 850° C. to 600° C.: 15° C./s Water cooling after reaching 600° C. Average cooling rate at or below 600° C.: 100° C./s | Average cooling rate from 850° C. to 600° C.: 0.4° C./s Water cooling after reaching 600° C. Average cooling rate at or below 600° C.: 100° C./s |
| First cold rolling | →1 mmt Working ratio 90% | Same as A1 | Same as A1 | Same as A1 | Same as A1 | Same as A1 | Same as A1 | Not provided, working ratio 0% | Same as A1 | Same as A1 |
| First aging treatment | 500° C. × 15 h | Same as A1 | Same as A1 | Same as A1 | Same as A1 | Not provided | 550° C. × 15 h | Same as A1 | Same as A1 | Same as A1 |
| Second cold rolling | →0.125 mmt Working ratio 88% | →0.111 mmt Working ratio 89% | →0.111 mmt Working ratio 89% | Same as A1 | Same as A1 | Same as A1 | Same as A1 | →0.125 mmt Working ratio 99% | Same as A1 | Same as A1 |
| Solution treatment | Maximum arrival temperature: 1020° C. (Co concentration: 3.0%, 4.0%): 990° C. (Co concentration: 1.0%, 1.5%) Maintained at maximum arrival temperature for 120 seconds, followed by water cooling Average cooling rate of from maximum arrival temperature to 400° C.: 100° C./s | Same as A1 | Same as A1 | Maximum arrival temperature: 1050° C. (Co concentration: 3.0%, 4.0%): 1020° C. (Co concentration: 1.0%, 1.5%) Maintained at maximum arrival temperature for 120 seconds, followed by water cooling Average cooling rate of from maximum arrival temperature to 400° C.: 100° C./s | Maximum arrival temperature: 1000° C. (Co concentration: 3.0%, 4.0%): 970° C. (Co concentration: 1.0%, 1.5%) Maintained at maximum arrival temperature for 120 seconds, followed by water cooling Average cooling rate of from maximum arrival temperature to 400° C.: 100° C./s | Same as A1 | Same as A1 | Same as A1 | Same as A1 | Same as A1 |
| Third cold rolling | →0.100 mmt Working ratio 20% | →0.089 mmt Working ratio 20% | →0.100 mmt Working ratio 10% | Same as A1 | Same as A1 | Same as A1 | Same as A1 | Same as A1 | Same as A1 | Same as A1 |
| Second aging treatment | 525° C. × 30 h | Same as A1 | Same as A1 | Same as A1 | Same as A1 | Same as A1 | Same as A1 | Same as A1 | Same as A1 | Same as A1 |
| Fourth cold rolling | →0.080 mmt Working ratio 20% | →0.080 mmt Working ratio 10% | →0.080 mmt Working ratio 20% | Same as A1 | Same as A1 | Same as A1 | Same as A1 | Same as A1 | Same as A1 | Same as A1 |
| Low temperature aging treatment or | 425° C. × 30 h | Same as A1 | Same as A1 | Same as A1 | Same as A1 | Same as A1 | Same as A1 | Same as A1 | Same as A1 | Same as A1 |

TABLE 2-1-continued

| stress relief annealing | | | | | | | | | | |
|---|---|---|---|---|---|---|---|---|---|---|
| Process | Example | | | | | | | | | |
| Melting | A11 | A12 | A13 | A14 | A15 | A16 | A17 | A18 | A19 | A20 |
| Hot rolling | Same as A1 | Same as A1 | Same as A1 | Same as A1 | Same as A1 | Same as A1 | Same as A1 | Same as A1 | Same as A1 | Same as A1 |
| First cold rolling | →7 mmt Working ratio 30% | Same as A1 | Same as A1 | Same as A1 | Same as A1 | Same as A1 | Same as A1 | Same as A1 | Same as A1 | Same as A1 |
| First aging treatment | Same as A1 | Same as A1 | Same as A1 | Same as A1 | Same as A1 | Same as A1 | Same as A1 | Same as A1 | Same as A1 | Same as A1 |
| Second cold rolling | →0.125 mmt Working ratio 98% | Same as A1 | Same as A1 | Same as A1 | →0.100mmt Working ratio 90% | →0.100 mmt Working ratio 90% | →0.100 mmt Working ratio 90% | →0.100 mmt Working ratio 90% | Same as A1 | →0.300 mmt Working ratio 70% |
| Solution treatment | Same as A1 | Maximum arrival temperature: same as A1 Maintained at maximum arrival temperature for 120 seconds, followed by furnace cooling Average cooling rate of from maximum arrival temperature to 400° C.: 15° C./s | Maximum arrival temperature: 1070° C. (Co concentration: 3.0%, 4.0%): 1040° C. (Co concentration: 1.0%, 1.5%) Maintained at maximum arrival temperature for 120 seconds, followed by water cooling Average cooling rate of from maximum arrival temperature to 400° C.: 100° C./s | Same as A1 | Same as A1 | Same as A1 | Same as A1 | Same as A1 | Same as A1 | Same as A1 |
| Third cold rolling | Same as A1 | Same as A1 | Same as A1 | Same as A1 | Not provided | Not provided | →0.080 mmt Working ratio 20% | Not provided | Same as A1 | →0.090 mmt Working ratio 70% |
| Second aging treatment | Same as A1 | Same as A1 | Same as A1 | Same as A1 | Same as A1 | Same as A1 | Same as A1 | Same as A1 | Same as A1 | Same as A1 |
| Fourth cold rolling | Same as A1 | Same as A1 | Same as A1 | Same as A1 | Same as A1 | Same as A1 | — | Same as A1 | Same as A1 | →0.080 mmt Working ratio 11% |
| Low temperature aging treatment or stress relief annealing | Same as A1 | Same as A1 | Same as A1 | 500° C. × 3 min | Same as A1 | 500° C. × 3 min | — | — | — | Same as A1 |

TABLE 2-1-continued

| Process | Example | | | | | | | | |
|---|---|---|---|---|---|---|---|---|---|
| Melting | B | C | D | E | F | G | H | I | J |
| Hot rolling | Same as A1 | Same as A1 | Same as A1 | Same as A1 | Same as A1 | After completion of hot rolling, cooling until material temperature reaches 850° C., followed by water cooling Average cooling rate of from 850° C. to 600° C.: 100° C./s Average cooling rate at or below 600° C.: 100° C./s | Average cooling rate from 850° C. to 600° C.: 0.05° C./s Water cooling after reaching 600° C. Average cooling rate at or below 600° C.: 100° C./s | Same as A1 | Same as A1 |
| First cold rolling | Same as A1 | Same as A1 | Same as A1 | Same as A1 | →5 mmt Working ratio 50% | Same as A1 | Same as A1 | Same as A1 | →5 mmt Working ratio 50% |
| First aging treatment | Same as A1 | Same as A1 | Same as A1 | 650° C. × 15 h | Same as A1 | Same as A1 | Same as A1 | Same as A1 | Same as A1 |
| Second cold rolling | →0.200 mmt Working ratio 80% | →0.200 mmt Working ratio 80% | Same as A1 | Same as A1 | →0.125 mmt Working ratio 98% | Same as A1 | Same as A1 | Same as A1 | →0.100 mmt Working ratio 98% |
| Solution treatment | Same as A1 | Same as A1 | Maximum arrival temperature: 830° C. (Co concentration: 3.0%, 4.0%): 800° C. (Co concentration: 1.0%, 1.5%) Maintained at maximum arrival temperature for 120 seconds, followed by water cooling Average cooling rate of from maximum arrival temperature to 400° C.: 100° C./s | Same as A1 | Same as A1 | Same as A1 | Same as A1 | Same as A1 | Same as A1 |
| Third cold rolling | →0.160 mmt Working ratio 20% | →0.100 mmt Working ratio 50% | Same as A1 | Same as A1 | Same as A1 | Same as A1 | Same as A1 | Not provided | Not provided |
| Second aging treatment | Same as A1 | Same as A1 | Same as A1 | Same as A1 | Same as A1 | Same as A1 | Same as A1 | Same as A1 | Same as A1 |
| Fourth cold rolling | →0.080 mmt Working ratio 50% | →0.080 mmt Working ratio 20% | Same as A1 | Same as A1 | Same as A1 | Same as A1 | Same as A1 | →0.063 mmt Working ratio 50% | Same as A1 |

TABLE 2-1-continued

| | | | | | | | | | |
|---|---|---|---|---|---|---|---|---|---|
| Low temperature aging treatment or stress relief annealing | Same as A1 | Same as A1 | Same as A1 | Same as A1 | Same as A1 | Same as A1 | Same as A1 | Same as A1 | 500° C. × 3 min |

Features of the various production conditions will be briefly described.

A1 is the optimal production conditions.

A2 is an example of decreasing the working ratio for the fourth cold rolling as compared with A1.

A3 is an example of decreasing the working ratio for the third cold rolling as compared with A1.

A4 is an example of increasing the maximum arrival temperature for the solution treatment as compared with A1.

A5 is an example of decreasing the maximum arrival temperature for the solution treatment as compared with A1.

A6 is an example of not providing the first aging treatment as compared with A1.

A7 is an example of increasing the temperature for the first aging treatment as compared with A1.

A8 is an example of not providing the first cold rolling and increasing the working ratio of the second cold rolling instead, as compared with A1.

A9 is an example of increasing the cooling rate after the completion of hot rolling as compared with A1.

A10 is an example of decreasing the cooling rate after the completion of hot rolling as compared with A1.

A11 is an example of decreasing the working ratio for the first cold rolling as compared with A1.

A12 is an example of decreasing the cooling rate for the solution treatment as compared with A1.

A13 is an example of further increasing the maximum arrival temperature for the solution treatment as compared with A1.

A14 is an example of conducting stress relief annealing as the final low temperature aging treatment as compared with A1.

A15 is an example of not providing the third cold rolling as compared with A1.

A16 is an example of not providing the third cold rolling and conducting stress relief annealing as the final low temperature aging treatment, as compared with A1.

A 17 is an example of not providing the fourth cold rolling and the low temperature aging treatment as compared with A1.

A18 is an example of not providing the third cold rolling and the low temperature aging treatment as compared with A1.

A19 is an example of not providing the low temperature aging treatment as compared with A1.

A20 is an example of increasing the working ratio for the third cold rolling as compared with A1.

B is an example of having an inappropriate working ratio for the fourth cold rolling.

C is an example of having an inappropriate working ratio for the third cold rolling.

D is an example of having an inappropriate maximum arrival temperature in the solution treatment.

E is an inappropriate example of performing the first aging treatment at a temperature that is unnecessarily high.

F is an example of having an inappropriate working ratio for the first cold rolling.

G is an inappropriate example because the cooling rate after the completion of hot rolling was too high.

H is an inappropriate example because the cooling rate after the completion of hot rolling was too low.

I is an example of having an inappropriate working ratio for the fourth cold rolling.

J is an example of having an inappropriate working ratio for the first cold rolling.

The various specimens obtained as described above were subjected to the evaluation of various characteristics as follows.

(1) Average grain size (GS)

A specimen was embedded in a resin such that the surface to be observed would be a cross-section in the direction which was parallel to the rolling direction, and the surface to be observed was subjected to mirror-surface finishing by mechanical polishing. Subsequently, in a solution prepared by mixing 100 parts by volume of water with 10 parts by volume of hydrochloric acid at a concentration of 36%, ferric chloride was dissolved in an amount of 5% by weight relative to the weight of the solution. The sample was immersed for 10 seconds in the solution thus formed, and the metal structure was exposed. Next, a photograph of this metal structure was taken with an optical microscope at a magnification of 100 times in a field of vision for observation in the range of 0.5 $mm^2$. Subsequently, based on the photograph, the average of the maximum diameter in the rolling direction and the maximum diameter in the thickness direction of an individual grain were determined for each grain, and the average values were calculated for various fields of vision for observation. Furthermore, the average value of 15 sites in the field of vision for observation was designated as the average grain size.

(2) Area ratio of discontinuous precipitation (DP) cells (DP area ratio) and average value of maximum width of discontinuous precipitation zone (DP maximum width average value)

An analysis was conducted by the method described above, by using Model XL30SFEG manufactured by Philips Electronics N.V. as an FE-SEM. Furthermore, it was confirmed by EDS (energy dispersive X-ray analysis) that the second phase particles constituting the discontinuous precipitation (DP) cells are made of cobalt silicide.

(3) 0.2% yield strength (YS)

A tensile test in a direction parallel to the rolling direction was carried out according to JIS-Z2241, and the 0.2% yield strength (YS: MPa) was measured.

(4) Peak 0.2% yield strength (peak YS) and overaged 0.2% yield strength (overaged YS)

The peak YS and overaged YS were determined, for specimens obtained not by performing a low temperature aging treatment but by performing cold rolling or stress relief annealing as the final process (specimens obtained in Processes A14, A16, A18, and A19 of Examples and Process J of Comparative Example), by further subjecting the specimens thus obtained to the following aging treatment.

Specimens of the same lot were respectively subjected to an aging treatment under thirteen conditions of an aging treatment time of 30 hours and an aging treatment temperature of 300° C., 325° C., 350° C., 375° C., 400° C., 425° C., 450° C., 475° C., 500° C., 525° C., 550° C., 575° C., and 600° C., and the 0.2% yield strength was measured for the respective specimens after the aging treatment. Among them, the highest 0.2% yield strength was designated as the peak YS, and the 0.2% yield strength of a specimen treated at an aging treatment temperature higher by 25° C. than the aging treatment temperature at which the peak YS was obtained was designated as the overaged YS. The 0.2% yield strength was measured by performing a tensile test in a direction parallel to the rolling direction according to JIS-Z2241.

On the other hand, for a specimen obtained by performing the second aging treatment as the final process (specimen obtained in Process A17 of Examples) and specimens obtained by performing a low temperature aging treatment as the final process (specimens obtained in Processes A1 to A13, A15, and A20 of Examples and Processes B to I of Comparative Examples), specimens of the same lot were subjected to the aging treatment just described above instead of the second aging treatment or low temperature aging treatment, and thereby the peak YS and the overaged YS were determined.

(5) ΔYS/peak YS

ΔYS was defined as follows:

$$\Delta YS = (\text{peak } YS) - (\text{overaged } YS)$$

Furthermore, the ratio of ΔYS/peak YS was defined as follows:

$$\Delta YS/\text{peak } YS \text{ ratio} = \Delta YS/\text{peak } YS \times 100(\%)$$

(6) Electrical conductivity (EC)

Volume resistivity was measured by a double bridge method, and thus the electrical conductivity (EC: % IACS) was determined.

(7) Average roughness of bent surface As a W bending test in a bad way (the axis of bending is in the same direction as the rolling direction), 90° bending work was carried out by using a W-shaped mold under the conditions in which the ratio of the sample sheet thickness and the bending radius was 1. Subsequently, the surface roughness Ra (μm) at the surface of the bending worked area was determined according to JIS B 0601 by using a confocal microscope.

(8) Rate of decrease of 0.2% yield strength after heating for 30 minutes at material temperature of 500° C.

A tensile test in the direction parallel to the rolling direction was carried out according to JIS-Z2241 before and after heating, and the 0.2% yield strength (YS: MPa) was measured. When the 0.2% yield strength before the heating treatment is designated as $YS_0$, and the 0.2% yield strength after the heating treatment is designated as $YS_1$, the rate of decrease is represented by the formula: rate of decrease $(\%) = (YS_0 - YS_1)/YS_0 \times 100$.

(9) Number density of continuous precipitates having particle size of 1 μm or greater A cross-section parallel to the rolling direction of the material was finished into a mirror-surface by mechanical polishing by using diamond polishing particles having a diameter of 1 μm, and then the mirror-surface was subjected to electrolytic polishing for 30 seconds in a 5% aqueous phosphoric acid solution at 20° C. at a voltage of 1.5 V. Through this electrolytic polishing, the matrix of Cu was dissolved, and the second phase particles remained undissolved and were exposed. This cross-section was observed at any arbitrary 10 sites by using an FE-SEM (field emission scanning electron microscope: manufactured by Philips Electronics N.V.) at a magnification of 3000 times (field of vision for observation: 30 μm×40 μm), the number of continuous precipitates having a particle size of 1 μm or greater was counted, and the average number per 1000 $\mu m^2$ was calculated. It was confirmed by using EDS (energy dispersive X-ray spectroscopy) that the continuous precipitates contained cobalt silicide.

The results are presented in Table 3. The results for the various specimens will be explained below.

No. 1-1 to 1-20, No. 2-1 to 2-20, No. 3-1 to 3-14, No. 4-1 to 4-14, No. 5-1 to 5-14, No. 6-1 to 6-14, No. 7-1 to 7-14, No. 8-1 to 8-14, No. 9-1 to 9-14, No. 10-1 to 10-14, No. 11-1 to 11-14, No. 12-1 to 12-14, No. 13-1 to 13-14, No. 14-1 to 14-14, No. 15-1 to 15-14, No. 16-1 to 16-20, and No. 17-1 to 17-20 are Examples of the present invention. Among them, No. 1-1, No. 2-1, No. 3-1, No. 4-1, No. 5-1, No. 6-1, No. 7-1, No. 8-1, No. 9-1, No. 10-1, No. 11-1, No. 12-1, No. 13-1, No. 14-1, No. 15-1, No. 16-1, and No. 17-1 produced under the production condition A1 exhibited the most excellent balance between strength and electrical conductivity when compared with samples of the same compositions.

On the other hand, No. 1-23, No. 2-23, No. 3-17, No. 4-17, No. 5-17, No. 16-23, and No. 17-23 produced under the production condition B, and No. 1-28, No. 2-28, No. 16-28, and No. 17-28 produced under the production condition I all had inappropriate working ratios for the fourth cold rolling, and therefore, discontinuous precipitates grew in the low temperature aging treatment process. Accordingly, the area ratio of DP cells and the average value of the maximum width increased, the balance between strength and electrical conductivity decreased as compared with the Invention Examples having the respective corresponding compositions, and bendability and heat resistance also deteriorated.

No. 1-22, No. 2-22, No. 3-16, No. 4-16, No. 5-16, No. 16-22, and No. 17-22 produced under the production condition C all had inappropriate working ratios for the third cold rolling, and therefore, discontinuous precipitates grew in the subsequent aging treatments. Accordingly, the area ratio of DP cells and the average value of the maximum width increased, the balance between strength and electrical conductivity decreased as compared with the Invention Examples having the respective corresponding compositions, and bendability and heat resistance also deteriorated.

No. 1-26, No. 2-26, No. 3-20, No. 4-20, No. 5-20, No. 16-26, and No. 17-26 produced under the production condition D all had lower maximum arrival temperatures for the solution treatment, and therefore, large amounts of non-solid-solubilized second phase particles (also including the discontinuous precipitates produced in the previous processes) remained behind. Further, discontinuous precipitates grew in the subsequent aging treatments. Accordingly, the area ratio of DP cells and the average value of the maximum width increased, the balance between strength and electrical conductivity decreased as compared with the Invention Examples having the respective corresponding compositions, and bendability and heat resistance also deteriorated.

In No. 1-27, No. 2-27, No. 3-21, No. 4-21, No. 5-21, No. 16-27, and No. 17-27 produced under the production condition E, the first aging treatment was carried out at a temperature that was unnecessarily high in all cases, and therefore, continuous precipitates and discontinuous precipitates grew into coarse particles. Accordingly, large amounts of continuous precipitates and discontinuous precipitates remained behind after the solution treatment, and the final area ratio of DP cells and the average value of the maximum width increased. The number of continuous precipitates having 1 μm or greater increased, the balance between strength and electrical conductivity decreased as compared with the Invention Examples having the respective corresponding compositions, and bendability and heat resistance also deteriorated.

No. 1-21, No. 2-21, No. 3-15, No. 4-15, No. 5-15, No. 16-21, and No. 17-21 produced under the production condition F, and No. 1-29, No. 2-29, No. 16-29, and No. 17-29 produced under the production condition J all had inappropriate working ratios for the first cold rolling, and therefore, discontinuous precipitates grew in the subsequent aging treatments. Accordingly, large amounts of discontinuous precipitates remained behind after the solution treatment, and the final area ratio of DP cells and the average value of the maximum width increased. The balance between strength and electrical conductivity decreased as compared with the Invention Examples having the respective corresponding compositions, and bendability and heat resistance also deteriorated.

No. 1-24, No. 2-24, No. 3-18, No. 4-18, No. 5-18, No. 16-24, and No. 17-24 produced under the production condition G all had excessively high cooling rates after the completion of hot rolling, and therefore, the recrystallized grains grew insufficiently, while discontinuous precipitates grew in the subsequent aging treatments. Accordingly, large amounts of discontinuous precipitates remained behind after the solution treatment, and the final area ratio of DP cells and the average value of the maximum width increased. The balance between strength and electrical conductivity decreased as compared with the Invention Examples having the respective corresponding compositions, and bendability and heat resistance also deteriorated.

In No. 1-25, No. 2-25, No. 3-19, No. 4-19, No. 5-19, No. 16-25, and No. 17-25 produced under the production condition H, the cooling rate after the completion of hot rolling was too low in all cases, and therefore, in addition to recrystallized grains, second phase particles containing discontinuous precipitates and continuous precipitates grew into coarse particles. Accordingly, large amounts of discontinuous/continuous precipitates remained behind after the solution treatment, and finally, large amounts of coarse discontinuous/continuous precipitates existed. The balance between strength and electrical conductivity decreased as compared with the Invention Examples having the respective corresponding compositions, and bendability and heat resistance also deteriorated.

Furthermore, although No. 18-1, No. 20-1, and No. 21-1 were produced under the production condition A1, since the compositions were not in the scope of the present invention, the balance between strength and electrical conductivity decreased.

Furthermore, although No. 19-1 was produced under the production condition A1, since the Co concentration and Si concentration were high and were not in the ranges of the present invention, cracks occurred at the time of hot rolling. Accordingly, production of products having this composition was terminated.

TABLE 3

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 μm$^2$) 25 or fewer |
|---|---|---|---|---|---|---|---|---|---|---|
| Invention Example No. | | | | | | | | | | |
| 1-1 | 15.2 | 2.2 | 0.8 | 2.9 | 19 | 674 | 57 | 0.33 | 7.0 | 12.1 |
| 1-2 | 16.1 | 2.6 | 1.1 | 3.4 | 22 | 661 | 57 | 0.44 | 6.7 | 10.6 |
| 1-3 | 15.9 | 2.6 | 0.9 | 3.4 | 22 | 657 | 58 | 0.37 | 6.8 | 11.4 |
| 1-4 | 16.7 | 3.1 | 0.9 | 3.4 | 23 | 656 | 58 | 0.37 | 7.1 | 11.9 |
| 1-5 | 13.6 | 3.3 | 1.0 | 3.4 | 23 | 662 | 57 | 0.44 | 7.2 | 12.4 |
| 1-6 | 19.0 | 2.7 | 1.0 | 3.6 | 24 | 658 | 58 | 0.42 | 7.6 | 16.8 |
| 1-7 | 14.4 | 2.3 | 0.9 | 3.1 | 21 | 661 | 56 | 0.38 | 6.4 | 11.2 |
| 1-8 | 18.5 | 2.8 | 1.0 | 3.3 | 21 | 660 | 57 | 0.51 | 6.8 | 17.8 |
| 1-9 | 17.9 | 3.1 | 1.2 | 3.5 | 23 | 658 | 57 | 0.47 | 7.6 | 11.9 |
| 1-10 | 18.8 | 3.0 | 1.0 | 3.1 | 21 | 670 | 54 | 0.36 | 6.6 | 9.9 |
| 1-11 | 15.2 | 2.6 | 0.9 | 3.2 | 21 | 660 | 57 | 0.34 | 7.0 | 12.1 |
| 1-12 | 16.6 | 2.6 | 1.0 | 3.2 | 22 | 671 | 57 | 0.41 | 6.9 | 11.2 |
| 1-13 | 27.4 | 0.3 | 0.4 | 1.9 | 13 | 677 | 52 | 1.32 | 4.6 | 8.1 |
| 1-14 | 15.2 | 2.2 | 0.9 | 2.5 | 16 | 659 | 55 | 0.36 | 6.2 | 9.9 |
| 1-15 | 15.6 | 2.4 | 0.9 | 3.1 | 21 | 655 | 56 | 0.22 | 6.3 | 11.6 |
| 1-16 | 15.5 | 1.7 | 0.7 | 2.1 | 14 | 654 | 55 | 0.20 | 4.6 | 10.8 |
| 1-17 | 15.3 | 1.6 | 0.7 | 2.0 | 13 | 634 | 54 | 0.24 | 4.4 | 11.2 |
| 1-18 | 15.5 | 1.7 | 0.8 | 2.1 | 13 | 626 | 53 | 0.20 | 4.3 | 10.5 |
| 1-19 | 16.0 | 1.6 | 0.7 | 1.9 | 12 | 652 | 54 | 0.30 | 4.0 | 10.3 |
| 1-20 | 16.3 | 2.9 | 0.9 | 3.4 | 22 | 657 | 58 | 0.55 | 6.9 | 11.7 |
| 2-1 | 18.1 | 3.3 | 1.2 | 3.4 | 29 | 851 | 53 | 0.60 | 7.1 | 15.5 |
| 2-2 | 18.1 | 3.3 | 1.2 | 3.4 | 29 | 841 | 52 | 0.68 | 7.1 | 13.5 |
| 2-3 | 18.7 | 3.2 | 1.1 | 3.4 | 28 | 831 | 54 | 0.61 | 7.5 | 14.0 |
| 2-4 | 18.5 | 3.5 | 1.0 | 3.3 | 27 | 821 | 55 | 0.57 | 7.0 | 15.2 |
| 2-5 | 17.2 | 4.1 | 1.3 | 3.8 | 33 | 854 | 52 | 0.66 | 8.5 | 15.0 |
| 2-6 | 20.4 | 3.0 | 1.0 | 3.6 | 30 | 832 | 55 | 0.71 | 7.6 | 18.8 |
| 2-7 | 16.2 | 2.9 | 1.1 | 3.1 | 27 | 856 | 51 | 0.80 | 7.1 | 13.1 |
| 2-8 | 20.6 | 3.4 | 1.1 | 3.5 | 29 | 835 | 54 | 0.73 | 7.3 | 21.0 |
| 2-9 | 18.9 | 3.5 | 1.3 | 4.0 | 33 | 841 | 53 | 0.74 | 8.4 | 17.1 |
| 2-10 | 18.8 | 3.2 | 1.1 | 3.2 | 27 | 841 | 51 | 0.56 | 6.8 | 13.1 |
| 2-11 | 18.1 | 3.6 | 1.2 | 3.4 | 29 | 848 | 53 | 0.63 | 7.1 | 15.6 |
| 2-12 | 19.4 | 3.7 | 1.3 | 3.4 | 29 | 860 | 52 | 0.67 | 7.2 | 15.3 |
| 2-13 | 28.5 | 0.6 | 0.8 | 2.1 | 18 | 870 | 49 | 1.61 | 6.4 | 10.6 |
| 2-14 | 18.5 | 3.0 | 1.1 | 3.1 | 26 | 836 | 52 | 0.69 | 7.5 | 13.3 |
| 2-15 | 17.8 | 2.8 | 1.2 | 2.9 | 24 | 832 | 53 | 0.42 | 6.1 | 13.5 |
| 2-16 | 18.5 | 2.5 | 1.1 | 2.6 | 22 | 833 | 52 | 0.45 | 5.6 | 12.8 |
| 2-17 | 18.2 | 2.7 | 1.1 | 2.6 | 23 | 811 | 50 | 0.51 | 4.4 | 14.5 |
| 2-18 | 18.4 | 2.8 | 1.2 | 2.6 | 23 | 793 | 48 | 0.54 | 4.3 | 11.9 |

TABLE 3-continued

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 $\mu m^2$) 25 or fewer |
|---|---|---|---|---|---|---|---|---|---|---|
| 2-19 | 19.5 | 2.6 | 1.0 | 2.4 | 21 | 809 | 51 | 0.58 | 4.5 | 12.1 |
| 2-20 | 18.5 | 3.4 | 1.0 | 3.4 | 27 | 825 | 54 | 0.89 | 7.2 | 14.5 |
| 3-1 | 17.3 | 3.1 | 0.9 | 2.7 | 24 | 873 | 51 | 0.77 | 5.6 | 16.7 |
| 2-2 | 18.7 | 3.4 | 1.3 | 3.1 | 27 | 859 | 49 | 0.88 | 7.7 | 14.7 |
| 3-3 | 19.8 | 3.3 | 1.1 | 3.0 | 25 | 850 | 50 | 0.81 | 7.6 | 15.2 |
| 3-4 | 18.8 | 3.5 | 1.0 | 3.2 | 27 | 839 | 51 | 0.80 | 7.9 | 17.1 |
| 3-5 | 16.8 | 3.7 | 1.2 | 3.8 | 33 | 863 | 49 | 0.87 | 7.8 | 14.8 |
| 3-6 | 20.8 | 3.6 | 1.1 | 3.1 | 26 | 845 | 50 | 0.86 | 6.6 | 19.2 |
| 3-7 | 17.1 | 3.3 | 1.1 | 2.9 | 25 | 876 | 48 | 0.82 | 7.4 | 16.7 |
| 3-8 | 20.7 | 3.6 | 1.2 | 3.3 | 28 | 853 | 50 | 0.95 | 8.1 | 19.8 |
| 3-9 | 17.9 | 4.1 | 1.4 | 4.1 | 35 | 865 | 49 | 0.95 | 9.1 | 17.5 |
| 3-10 | 20.2 | 3.3 | 1.1 | 3.1 | 27 | 870 | 47 | 0.74 | 7.0 | 12.7 |
| 3-11 | 17.5 | 3.3 | 1.0 | 2.8 | 25 | 874 | 51 | 0.78 | 5.9 | 16.4 |
| 3-12 | 18.4 | 3.4 | 1.1 | 3.1 | 27 | 881 | 49 | 0.83 | 6.4 | 15.0 |
| 3-13 | 28.5 | 0.6 | 0.7 | 2.3 | 21 | 908 | 46 | 1.77 | 4.8 | 12.2 |
| 3-14 | 17.4 | 3.0 | 1.2 | 2.7 | 23 | 862 | 49 | 0.60 | 5.9 | 14.4 |
| 4-1 | 17.3 | 3.4 | 0.9 | 2.9 | 25 | 851 | 54 | 0.55 | 6.0 | 18.1 |
| 4-2 | 16.9 | 3.3 | 1.2 | 3.3 | 28 | 834 | 52 | 0.66 | 7.3 | 15.5 |
| 4-3 | 17.8 | 3.4 | 1.1 | 2.7 | 23 | 824 | 54 | 0.59 | 6.1 | 14.7 |
| 4-4 | 17.3 | 3.7 | 1.1 | 3.3 | 27 | 813 | 54 | 0.56 | 7.2 | 18.8 |
| 4-5 | 15.5 | 4.0 | 1.1 | 3.3 | 27 | 835 | 52 | 0.64 | 6.6 | 16.2 |
| 4-6 | 19.2 | 3.6 | 1.1 | 2.9 | 24 | 820 | 55 | 0.62 | 6.4 | 21.6 |
| 4-7 | 15.2 | 3.5 | 1.0 | 3.3 | 27 | 835 | 52 | 0.58 | 6.9 | 14.7 |
| 4-8 | 19.3 | 3.6 | 1.2 | 3.7 | 31 | 850 | 51 | 0.62 | 8.1 | 22.3 |
| 4-9 | 16.9 | 3.9 | 1.4 | 3.6 | 30 | 838 | 53 | 0.72 | 7.8 | 17.7 |
| 4-10 | 18.0 | 3.2 | 0.9 | 2.7 | 22 | 836 | 50 | 0.54 | 5.4 | 14.5 |
| 4-11 | 17.3 | 3.4 | 1.0 | 3.0 | 25 | 849 | 54 | 0.56 | 6.1 | 17.8 |
| 4-12 | 17.9 | 3.5 | 1.0 | 3.2 | 27 | 855 | 54 | 0.57 | 6.6 | 16.9 |
| 4-13 | 27.2 | 0.9 | 0.5 | 2.3 | 21 | 881 | 50 | 1.48 | 5.2 | 13.5 |
| 4-14 | 17.4 | 3.1 | 1.0 | 2.8 | 23 | 836 | 53 | 0.37 | 6.3 | 15.5 |
| 5-1 | 18.7 | 3.4 | 1.1 | 3.3 | 28 | 866 | 46 | 0.59 | 6.8 | 17.1 |
| 5-2 | 18.9 | 3.7 | 1.3 | 3.1 | 26 | 840 | 43 | 0.74 | 6.9 | 15.5 |
| 5-3 | 19.2 | 3.4 | 1.2 | 3.2 | 27 | 846 | 44 | 0.67 | 6.4 | 14.0 |
| 5-4 | 19.1 | 3.8 | 1.1 | 3.2 | 26 | 820 | 46 | 0.60 | 9.1 | 19.6 |
| 5-5 | 17.6 | 4.0 | 1.2 | 3.3 | 28 | 869 | 45 | 0.68 | 6.6 | 16.4 |
| 5-6 | 21.0 | 3.5 | 1.2 | 3.4 | 28 | 839 | 45 | 0.70 | 7.3 | 20.4 |
| 5-7 | 16.6 | 3.4 | 1.1 | 2.9 | 25 | 873 | 43 | 0.66 | 6.3 | 15.1 |
| 5-8 | 21.1 | 3.8 | 1.3 | 3.3 | 28 | 860 | 41 | 0.76 | 7.6 | 21.6 |
| 5-9 | 19.5 | 4.1 | 1.4 | 3.5 | 30 | 840 | 45 | 0.76 | 7.1 | 17.9 |
| 5-10 | 19.4 | 3.8 | 1.0 | 3.0 | 26 | 860 | 43 | 0.62 | 6.7 | 14.5 |
| 5-11 | 18.7 | 3.5 | 1.1 | 3.2 | 28 | 860 | 45 | 0.62 | 6.8 | 16.8 |
| 5-12 | 19.7 | 3.6 | 1.3 | 3.5 | 30 | 870 | 44 | 0.66 | 7.1 | 15.5 |
| 5-13 | 29.1 | 1.0 | 0.8 | 2.4 | 22 | 891 | 41 | 1.71 | 5.8 | 12.8 |
| 5-14 | 18.9 | 3.3 | 1.2 | 3.2 | 27 | 851 | 44 | 0.75 | 6.8 | 14.6 |
| 6-1 | 16.0 | 3.2 | 1.1 | 3.0 | 26 | 850 | 54 | 0.7 | 6.8 | 16.5 |
| 6-2 | 16.0 | 3.2 | 1.2 | 3.0 | 25 | 840 | 53 | 0.8 | 6.8 | 14.0 |
| 6-3 | 16.7 | 3.1 | 1.0 | 3.4 | 29 | 836 | 54 | 0.7 | 7.1 | 15.7 |
| 6-4 | 17.1 | 3.5 | 1.0 | 3.0 | 25 | 819 | 56 | 0.7 | 6.9 | 17.5 |
| 6-5 | 15.5 | 3.7 | 1.1 | 3.5 | 30 | 853 | 54 | 0.7 | 8.3 | 15.0 |
| 6-6 | 19.1 | 3.5 | 1.1 | 3.5 | 29 | 831 | 55 | 0.7 | 7.0 | 20.8 |
| 6-7 | 15.1 | 3.5 | 1.0 | 2.9 | 25 | 847 | 53 | 0.7 | 6.8 | 15.3 |
| 6-8 | 19.2 | 3.5 | 1.2 | 3.0 | 25 | 832 | 55 | 0.8 | 6.8 | 21.8 |
| 6-9 | 17.9 | 3.8 | 1.3 | 3.7 | 31 | 840 | 53 | 0.8 | 8.0 | 18.1 |
| 6-10 | 16.2 | 3.7 | 1.1 | 2.9 | 25 | 851 | 51 | 0.6 | 6.1 | 13.9 |
| 6-11 | 16.0 | 3.7 | 1.1 | 3.0 | 26 | 847 | 54 | 0.7 | 6.8 | 15.8 |
| 6-12 | 16.7 | 3.7 | 1.1 | 3.0 | 26 | 858 | 52 | 0.8 | 6.7 | 14.9 |
| 6-13 | 26.6 | 0.9 | 0.8 | 2.1 | 18 | 869 | 49 | 1.7 | 6.1 | 11.9 |
| 6-14 | 16.4 | 2.8 | 1.2 | 2.9 | 25 | 834 | 52 | 0.8 | 6.6 | 13.9 |
| 7-1 | 19.0 | 3.4 | 1.2 | 3.2 | 28 | 863 | 49 | 0.71 | 7.1 | 15.7 |
| 7-2 | 19.0 | 3.7 | 1.4 | 3.2 | 28 | 856 | 49 | 0.84 | 7.1 | 14.9 |
| 7-3 | 19.6 | 3.3 | 1.1 | 3.5 | 30 | 852 | 52 | 0.73 | 7.6 | 14.4 |
| 7-4 | 19.7 | 3.4 | 1.0 | 3.2 | 27 | 839 | 53 | 0.70 | 7.0 | 16.4 |
| 7-5 | 18.2 | 3.7 | 1.2 | 3.7 | 32 | 865 | 49 | 0.81 | 8.6 | 14.4 |
| 7-6 | 21.6 | 3.6 | 1.2 | 3.6 | 30 | 844 | 49 | 0.79 | 7.6 | 19.3 |
| 7-7 | 17.5 | 3.5 | 1.1 | 3.1 | 27 | 868 | 48 | 0.74 | 7.1 | 15.6 |
| 7-8 | 21.7 | 3.5 | 1.3 | 3.2 | 28 | 857 | 48 | 0.80 | 7.4 | 23.3 |
| 7-9 | 20.2 | 4.0 | 1.4 | 3.9 | 33 | 851 | 49 | 0.81 | 8.5 | 17.4 |
| 7-10 | 19.5 | 3.5 | 1.1 | 3.1 | 27 | 862 | 48 | 0.68 | 6.8 | 13.3 |

TABLE 3-continued

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 $\mu m^2$) 25 or fewer |
|---|---|---|---|---|---|---|---|---|---|---|
| 7-11 | 19.0 | 3.5 | 1.2 | 3.2 | 28 | 861 | 50 | 0.75 | 7.1 | 15.1 |
| 7-12 | 20.0 | 3.5 | 1.3 | 3.2 | 28 | 881 | 48 | 0.82 | 7.3 | 14.4 |
| 7-13 | 29.4 | 0.6 | 0.8 | 2.1 | 18 | 883 | 47 | 1.79 | 6.4 | 11.2 |
| 7-14 | 19.3 | 3.0 | 1.2 | 3.0 | 26 | 861 | 46 | 0.86 | 7.6 | 13.4 |
| 8-1 | 15.6 | 3.4 | 1.0 | 2.9 | 25 | 859 | 54 | 0.68 | 6.8 | 16.7 |
| 8-2 | 15.6 | 3.3 | 1.2 | 2.9 | 25 | 851 | 53 | 0.79 | 6.8 | 14.1 |
| 8-3 | 16.3 | 3.4 | 1.0 | 3.4 | 29 | 847 | 54 | 0.70 | 7.0 | 16.1 |
| 8-4 | 16.9 | 3.3 | 1.1 | 2.9 | 24 | 833 | 56 | 0.67 | 6.9 | 17.8 |
| 8-5 | 15.1 | 3.5 | 1.1 | 3.4 | 30 | 868 | 54 | 0.77 | 8.2 | 15.2 |
| 8-6 | 18.8 | 3.3 | 1.1 | 3.5 | 29 | 839 | 55 | 0.75 | 6.9 | 21.2 |
| 8-7 | 14.9 | 3.3 | 1.0 | 2.9 | 25 | 861 | 53 | 0.71 | 6.8 | 13.4 |
| 8-8 | 18.9 | 3.3 | 1.1 | 3.0 | 25 | 854 | 54 | 0.78 | 6.7 | 22.4 |
| 8-9 | 17.8 | 3.9 | 1.3 | 3.6 | 31 | 848 | 54 | 0.79 | 7.9 | 18.3 |
| 8-10 | 15.7 | 3.8 | 1.1 | 2.9 | 25 | 858 | 51 | 0.65 | 6.0 | 14.1 |
| 8-11 | 15.6 | 3.8 | 1.1 | 3.3 | 28 | 856 | 54 | 0.71 | 6.8 | 16.0 |
| 8-12 | 16.1 | 3.6 | 1.1 | 2.9 | 26 | 874 | 52 | 0.78 | 6.6 | 15.0 |
| 8-13 | 26.2 | 0.9 | 0.8 | 2.1 | 18 | 878 | 49 | 1.74 | 6.0 | 12.1 |
| 8-14 | 16.0 | 2.6 | 1.1 | 2.9 | 25 | 852 | 52 | 0.81 | 6.4 | 14.0 |
| 9-1 | 16.4 | 3.3 | 1.1 | 3.1 | 26 | 851 | 54 | 0.65 | 6.9 | 16.3 |
| 9-2 | 16.4 | 3.2 | 1.2 | 3.1 | 26 | 841 | 53 | 0.75 | 6.9 | 13.9 |
| 9-3 | 17.1 | 3.2 | 1.1 | 3.5 | 29 | 836 | 54 | 0.67 | 7.2 | 15.4 |
| 9-4 | 17.4 | 3.2 | 1.0 | 3.1 | 25 | 820 | 55 | 0.64 | 6.9 | 17.2 |
| 9-5 | 15.8 | 3.4 | 1.1 | 3.6 | 30 | 853 | 54 | 0.73 | 8.3 | 14.9 |
| 9-6 | 19.4 | 3.2 | 1.1 | 3.5 | 29 | 831 | 55 | 0.72 | 7.1 | 20.4 |
| 9-7 | 15.3 | 3.2 | 1.1 | 3.0 | 25 | 848 | 53 | 0.68 | 6.9 | 14.3 |
| 9-8 | 19.4 | 3.2 | 1.2 | 3.1 | 26 | 840 | 54 | 0.76 | 6.9 | 22.8 |
| 9-9 | 18.1 | 3.8 | 1.4 | 3.8 | 32 | 840 | 53 | 0.77 | 8.1 | 17.9 |
| 9-10 | 16.7 | 3.5 | 1.1 | 3.0 | 26 | 851 | 51 | 0.62 | 6.3 | 13.7 |
| 9-11 | 16.4 | 3.4 | 1.2 | 3.1 | 26 | 847 | 54 | 0.69 | 6.9 | 15.6 |
| 9-12 | 17.2 | 3.4 | 1.2 | 3.1 | 27 | 859 | 52 | 0.74 | 6.8 | 14.7 |
| 9-13 | 27.0 | 0.5 | 0.8 | 2.1 | 18 | 869 | 49 | 1.70 | 6.1 | 11.7 |
| 9-14 | 16.8 | 2.6 | 1.1 | 3.0 | 25 | 835 | 52 | 0.77 | 6.8 | 13.8 |
| 10-1 | 17.5 | 3.5 | 1.1 | 3.3 | 28 | 851 | 54 | 0.62 | 7.0 | 15.8 |
| 10-2 | 17.5 | 3.5 | 1.3 | 3.3 | 28 | 841 | 53 | 0.71 | 7.0 | 14.7 |
| 10-3 | 18.1 | 3.3 | 1.1 | 3.5 | 30 | 837 | 54 | 0.63 | 7.4 | 14.5 |
| 10-4 | 18.1 | 3.6 | 1.0 | 3.3 | 27 | 820 | 55 | 0.60 | 7.0 | 16.5 |
| 10-5 | 16.7 | 3.8 | 1.2 | 3.7 | 32 | 854 | 54 | 0.69 | 8.5 | 14.5 |
| 10-6 | 20.0 | 3.7 | 1.2 | 3.6 | 30 | 832 | 55 | 0.68 | 7.4 | 19.4 |
| 10-7 | 15.9 | 3.6 | 1.1 | 3.1 | 27 | 848 | 53 | 0.64 | 7.0 | 16.5 |
| 10-8 | 20.2 | 3.6 | 1.3 | 3.3 | 27 | 831 | 52 | 0.74 | 7.1 | 21.2 |
| 10-9 | 18.6 | 3.7 | 1.3 | 4.0 | 34 | 841 | 53 | 0.75 | 8.3 | 17.4 |
| 10-10 | 18.0 | 3.5 | 1.1 | 3.1 | 27 | 852 | 51 | 0.58 | 6.6 | 13.3 |
| 10-11 | 17.5 | 3.5 | 1.2 | 3.3 | 28 | 848 | 53 | 0.65 | 7.0 | 15.1 |
| 10-12 | 18.6 | 3.6 | 1.2 | 3.3 | 28 | 859 | 52 | 0.70 | 7.0 | 14.4 |
| 10-13 | 27.9 | 0.6 | 0.8 | 2.1 | 18 | 870 | 49 | 1.64 | 6.3 | 11.2 |
| 10-14 | 17.8 | 3.1 | 1.2 | 3.1 | 26 | 836 | 52 | 0.72 | 7.2 | 13.5 |
| 11-1 | 15.1 | 3.3 | 1.0 | 2.8 | 25 | 865 | 53 | 0.70 | 6.7 | 16.9 |
| 11-2 | 15.1 | 3.2 | 1.1 | 2.9 | 24 | 859 | 52 | 0.81 | 6.7 | 14.2 |
| 11-3 | 15.8 | 3.3 | 1.0 | 3.4 | 29 | 855 | 54 | 0.71 | 6.9 | 16.5 |
| 11-4 | 16.5 | 3.3 | 1.0 | 2.8 | 24 | 843 | 55 | 0.69 | 6.8 | 18.2 |
| 11-5 | 14.7 | 3.4 | 1.0 | 3.7 | 32 | 866 | 53 | 0.79 | 8.2 | 15.4 |
| 11-6 | 18.5 | 3.1 | 1.1 | 3.5 | 30 | 846 | 54 | 0.77 | 6.8 | 21.7 |
| 11-7 | 14.6 | 3.2 | 1.0 | 2.8 | 25 | 872 | 52 | 0.72 | 6.7 | 14.9 |
| 11-8 | 18.5 | 3.2 | 1.1 | 2.9 | 25 | 862 | 54 | 0.79 | 6.6 | 22.3 |
| 11-9 | 17.5 | 3.6 | 1.3 | 3.5 | 30 | 854 | 53 | 0.80 | 7.8 | 18.5 |
| 11-10 | 15.1 | 3.8 | 1.1 | 3.4 | 30 | 864 | 51 | 0.66 | 5.9 | 14.3 |
| 11-11 | 15.1 | 3.7 | 1.1 | 2.8 | 25 | 864 | 53 | 0.73 | 6.7 | 16.2 |
| 11-12 | 15.4 | 3.6 | 1.1 | 2.9 | 25 | 878 | 51 | 0.80 | 6.5 | 15.2 |
| 11-13 | 25.7 | 0.9 | 0.7 | 2.1 | 18 | 886 | 49 | 1.76 | 5.9 | 12.4 |
| 11-14 | 15.5 | 2.4 | 1.1 | 2.9 | 25 | 866 | 51 | 0.84 | 6.2 | 14.1 |
| 12-1 | 16.6 | 3.4 | 1.1 | 3.1 | 27 | 856 | 54 | 0.65 | 6.9 | 16.2 |
| 12-2 | 16.6 | 3.2 | 1.2 | 3.1 | 27 | 847 | 53 | 0.75 | 6.9 | 13.9 |
| 12-3 | 17.3 | 3.3 | 1.1 | 3.5 | 29 | 843 | 54 | 0.66 | 7.2 | 15.2 |
| 12-4 | 17.5 | 3.3 | 1.0 | 3.1 | 26 | 828 | 55 | 0.63 | 6.9 | 17.1 |
| 12-5 | 16.0 | 3.5 | 1.1 | 3.6 | 31 | 863 | 54 | 0.72 | 8.3 | 14.8 |
| 12-6 | 19.5 | 3.3 | 1.1 | 3.5 | 30 | 836 | 55 | 0.71 | 7.2 | 20.3 |
| 12-7 | 15.4 | 3.2 | 1.1 | 3.0 | 26 | 856 | 53 | 0.67 | 6.9 | 15.8 |
| 12-8 | 19.6 | 3.2 | 1.2 | 3.1 | 26 | 840 | 55 | 0.76 | 6.9 | 21.8 |

TABLE 3-continued

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 $\mu m^2$) 25 or fewer |
|---|---|---|---|---|---|---|---|---|---|---|
| 12-9 | 18.2 | 3.7 | 1.4 | 3.8 | 32 | 845 | 53 | 0.77 | 8.1 | 17.8 |
| 12-10 | 16.9 | 3.5 | 1.1 | 3.0 | 26 | 856 | 51 | 0.61 | 6.3 | 13.7 |
| 12-11 | 16.6 | 3.5 | 1.2 | 3.1 | 27 | 853 | 54 | 0.68 | 6.9 | 15.5 |
| 12-12 | 17.4 | 3.4 | 1.2 | 3.1 | 27 | 868 | 52 | 0.73 | 6.8 | 14.7 |
| 12-13 | 27.1 | 0.5 | 0.8 | 2.1 | 18 | 875 | 49 | 1.69 | 6.1 | 11.6 |
| 12-14 | 17.0 | 2.7 | 1.1 | 3.0 | 25 | 846 | 52 | 0.76 | 6.8 | 13.7 |
| 13-1 | 16.3 | 3.3 | 1.1 | 3.1 | 26 | 857 | 53 | 0.66 | 6.9 | 16.3 |
| 13-2 | 16.3 | 3.1 | 1.2 | 3.1 | 26 | 848 | 53 | 0.76 | 6.9 | 13.9 |
| 13-3 | 16.9 | 3.2 | 1.0 | 3.4 | 29 | 844 | 54 | 0.67 | 7.2 | 15.5 |
| 13-4 | 17.3 | 3.2 | 1.0 | 3.1 | 26 | 832 | 55 | 0.64 | 6.9 | 17.3 |
| 13-5 | 15.7 | 3.4 | 1.1 | 3.5 | 30 | 860 | 53 | 0.74 | 8.3 | 14.9 |
| 13-6 | 19.3 | 3.1 | 1.1 | 3.5 | 30 | 837 | 54 | 0.73 | 7.1 | 20.6 |
| 13-7 | 15.2 | 3.2 | 1.1 | 3.0 | 26 | 857 | 53 | 0.68 | 6.9 | 17.0 |
| 13-8 | 19.3 | 3.1 | 1.2 | 3.1 | 26 | 843 | 53 | 0.77 | 6.8 | 23.0 |
| 13-9 | 18.1 | 3.8 | 1.3 | 3.8 | 32 | 846 | 53 | 0.78 | 8.0 | 18.0 |
| 13-10 | 16.5 | 3.5 | 1.1 | 3.0 | 26 | 857 | 51 | 0.62 | 6.2 | 13.8 |
| 13-11 | 16.3 | 3.4 | 1.1 | 3.1 | 26 | 854 | 53 | 0.69 | 6.9 | 15.7 |
| 13-12 | 17.0 | 3.3 | 1.2 | 3.1 | 27 | 870 | 52 | 0.75 | 6.8 | 14.8 |
| 13-13 | 26.8 | 0.5 | 0.8 | 2.1 | 18 | 876 | 49 | 1.70 | 6.1 | 11.8 |
| 13-14 | 16.7 | 2.6 | 1.1 | 3.0 | 25 | 848 | 51 | 0.78 | 6.7 | 13.8 |
| 14-1 | 14.5 | 3.1 | 1.0 | 2.7 | 23 | 855 | 54 | 0.71 | 6.6 | 17.2 |
| 14-2 | 14.5 | 3.1 | 1.1 | 2.7 | 23 | 846 | 53 | 0.84 | 6.7 | 14.3 |
| 14-3 | 15.2 | 3.2 | 1.0 | 3.3 | 28 | 841 | 54 | 0.73 | 6.8 | 17.0 |
| 14-4 | 16.2 | 3.2 | 0.9 | 2.7 | 22 | 826 | 55 | 0.71 | 6.8 | 18.5 |
| 14-5 | 14.2 | 3.3 | 1.0 | 3.4 | 29 | 861 | 54 | 0.81 | 8.1 | 15.6 |
| 14-6 | 18.2 | 3.0 | 1.1 | 3.5 | 29 | 835 | 55 | 0.79 | 6.6 | 22.3 |
| 14-7 | 14.4 | 3.1 | 1.0 | 2.7 | 24 | 860 | 53 | 0.74 | 6.7 | 16.0 |
| 14-8 | 18.1 | 3.1 | 1.1 | 2.8 | 24 | 851 | 55 | 0.80 | 6.4 | 21.2 |
| 14-9 | 17.3 | 3.5 | 1.3 | 3.4 | 29 | 844 | 53 | 0.82 | 7.7 | 18.8 |
| 14-10 | 14.4 | 3.3 | 1.0 | 2.7 | 23 | 855 | 51 | 0.68 | 5.7 | 14.5 |
| 14-11 | 14.5 | 3.5 | 1.1 | 3.0 | 26 | 852 | 54 | 0.75 | 6.7 | 16.4 |
| 14-12 | 14.7 | 3.6 | 1.2 | 3.1 | 27 | 866 | 52 | 0.82 | 6.3 | 15.4 |
| 14-13 | 25.2 | 1.0 | 0.7 | 2.1 | 18 | 874 | 49 | 1.79 | 5.8 | 12.6 |
| 14-14 | 14.9 | 2.2 | 1.1 | 2.8 | 24 | 843 | 52 | 0.86 | 6.0 | 14.3 |
| 15-1 | 15.0 | 3.1 | 1.0 | 2.8 | 24 | 850 | 54 | 0.70 | 6.7 | 17.0 |
| 15-2 | 15.0 | 3.1 | 1.1 | 2.8 | 24 | 840 | 54 | 0.82 | 6.7 | 14.2 |
| 15-3 | 15.7 | 3.2 | 1.0 | 3.3 | 28 | 835 | 54 | 0.72 | 6.9 | 16.6 |
| 15-4 | 16.5 | 3.3 | 1.1 | 2.8 | 23 | 819 | 56 | 0.69 | 6.8 | 18.2 |
| 15-5 | 14.6 | 3.5 | 1.0 | 3.5 | 30 | 852 | 54 | 0.79 | 8.1 | 15.4 |
| 15-6 | 18.4 | 3.2 | 1.1 | 3.5 | 29 | 831 | 55 | 0.78 | 6.7 | 21.8 |
| 15-7 | 14.6 | 3.2 | 1.0 | 2.8 | 24 | 847 | 54 | 0.73 | 6.7 | 15.3 |
| 15-8 | 18.4 | 3.2 | 1.1 | 2.8 | 24 | 846 | 55 | 0.79 | 6.5 | 22.0 |
| 15-9 | 17.5 | 3.4 | 1.3 | 3.5 | 29 | 839 | 54 | 0.81 | 7.8 | 18.6 |
| 15-10 | 14.9 | 3.7 | 1.1 | 3.1 | 26 | 851 | 53 | 0.67 | 5.8 | 14.3 |
| 15-11 | 15.0 | 3.5 | 1.1 | 3.1 | 26 | 847 | 54 | 0.74 | 6.7 | 16.2 |
| 15-12 | 15.3 | 3.7 | 1.1 | 3.2 | 27 | 857 | 53 | 0.81 | 6.4 | 15.2 |
| 15-13 | 25.6 | 1.0 | 0.7 | 2.1 | 18 | 868 | 50 | 1.77 | 5.9 | 12.4 |
| 15-14 | 15.4 | 2.4 | 1.0 | 2.9 | 24 | 833 | 52 | 0.84 | 6.1 | 14.1 |
| 16-1 | 16.0 | 1.3 | 0.4 | 2.5 | 16 | 635 | 63 | 0.27 | 5.2 | 7.3 |
| 16-2 | 16.9 | 1.4 | 0.6 | 2.9 | 18 | 622 | 65 | 0.48 | 4.9 | 5.8 |
| 16-3 | 16.9 | 1.4 | 0.3 | 3.0 | 18 | 617 | 64 | 0.33 | 5.0 | 6.7 |
| 16-4 | 17.5 | 2.0 | 0.4 | 3.1 | 19 | 618 | 65 | 0.34 | 5.2 | 7.1 |
| 16-5 | 14.5 | 2.3 | 0.6 | 3.1 | 19 | 624 | 63 | 0.47 | 5.5 | 7.5 |
| 16-6 | 19.9 | 1.7 | 0.5 | 3.4 | 21 | 618 | 65 | 0.44 | 5.7 | 11.8 |
| 16-7 | 15.4 | 1.1 | 0.5 | 2.8 | 17 | 622 | 64 | 0.37 | 4.5 | 6.3 |
| 16-8 | 19.3 | 1.7 | 0.4 | 3.0 | 19 | 620 | 65 | 0.62 | 4.9 | 12.9 |
| 16-9 | 18.7 | 2.0 | 0.7 | 3.2 | 20 | 620 | 65 | 0.53 | 5.6 | 7.1 |
| 16-10 | 19.6 | 1.7 | 0.5 | 2.7 | 17 | 631 | 61 | 0.32 | 4.9 | 5.0 |
| 16-11 | 16.0 | 1.4 | 0.4 | 2.9 | 18 | 620 | 63 | 0.27 | 5.1 | 7.2 |
| 16-12 | 17.5 | 1.4 | 0.4 | 3.0 | 19 | 632 | 66 | 0.42 | 4.9 | 6.3 |
| 16-13 | 28.3 | 0.0 | 0.0 | 1.4 | 9 | 638 | 60 | 1.34 | 2.6 | 3.4 |
| 16-14 | 16.0 | 1.1 | 0.4 | 2.0 | 13 | 621 | 61 | 0.33 | 4.4 | 5.2 |
| 16-15 | 16.6 | 1.4 | 0.3 | 2.8 | 17 | 616 | 64 | 0.34 | 4.5 | 6.9 |
| 16-16 | 16.3 | 0.5 | 0.2 | 1.6 | 10 | 614 | 62 | 0.30 | 2.7 | 5.8 |
| 16-17 | 16.3 | 0.5 | 0.2 | 1.7 | 10 | 594 | 60 | 0.38 | 2.5 | 6.3 |
| 16-18 | 16.3 | 0.5 | 0.4 | 1.6 | 9 | 587 | 61 | 0.30 | 2.4 | 5.5 |
| 16-19 | 16.9 | 0.5 | 0.2 | 1.5 | 9 | 613 | 60 | 0.20 | 2.1 | 5.4 |
| 16-20 | 17.2 | 1.7 | 0.4 | 3.0 | 19 | 618 | 65 | 0.50 | 5.1 | 6.9 |

TABLE 3-continued

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 μm$^2$) 25 or fewer |
|---|---|---|---|---|---|---|---|---|---|---|
| 17-1 | 11.0 | 4.4 | 1.7 | 4.4 | 41 | 929 | 45 | 0.94 | 8.5 | 20.6 |
| 17-2 | 11.0 | 4.5 | 1.5 | 4.3 | 40 | 918 | 42 | 1.08 | 8.5 | 18.6 |
| 17-3 | 11.6 | 4.6 | 1.6 | 4.3 | 39 | 906 | 43 | 0.96 | 8.7 | 19.1 |
| 17-4 | 11.3 | 4.8 | 1.5 | 4.3 | 39 | 898 | 46 | 1.17 | 8.4 | 20.4 |
| 17-5 | 10.1 | 4.9 | 1.6 | 4.9 | 46 | 932 | 42 | 1.05 | 9.9 | 20.0 |
| 17-6 | 13.4 | 4.1 | 1.5 | 4.4 | 40 | 908 | 44 | 1.15 | 8.9 | 24.0 |
| 17-7 | 8.9 | 4.2 | 1.7 | 4.0 | 37 | 932 | 40 | 1.33 | 8.4 | 18.3 |
| 17-8 | 13.4 | 4.6 | 1.6 | 4.5 | 41 | 911 | 43 | 1.19 | 8.6 | 26.0 |
| 17-9 | 11.9 | 4.9 | 1.6 | 4.8 | 44 | 917 | 44 | 1.20 | 9.7 | 22.2 |
| 17-10 | 11.6 | 4.5 | 1.5 | 4.2 | 39 | 917 | 40 | 1.15 | 8.2 | 18.2 |
| 17-11 | 11.0 | 4.7 | 1.6 | 4.4 | 40 | 925 | 45 | 0.98 | 8.5 | 20.6 |
| 17-12 | 12.2 | 4.8 | 1.6 | 4.3 | 41 | 937 | 42 | 1.07 | 8.7 | 20.3 |
| 17-13 | 21.5 | 1.7 | 1.4 | 2.9 | 27 | 945 | 39 | 2.05 | 7.6 | 15.7 |
| 17-14 | 11.3 | 4.1 | 1.5 | 4.1 | 37 | 914 | 42 | 1.11 | 8.9 | 18.4 |
| 17-15 | 10.7 | 4.0 | 1.8 | 3.9 | 36 | 908 | 44 | 0.87 | 7.5 | 18.5 |
| 17-16 | 11.3 | 3.7 | 1.6 | 3.6 | 33 | 910 | 42 | 0.93 | 7.0 | 18.0 |
| 17-17 | 11.0 | 3.8 | 1.5 | 3.5 | 31 | 888 | 42 | 1.05 | 5.9 | 19.7 |
| 17-18 | 11.3 | 4.1 | 1.8 | 3.7 | 32 | 870 | 37 | 1.12 | 5.6 | 17.1 |
| 17-19 | 12.2 | 4.0 | 1.4 | 3.2 | 29 | 887 | 43 | 1.19 | 6.0 | 17.3 |
| 17-20 | 11.5 | 4.7 | 1.6 | 4.3 | 39 | 902 | 44 | 1.21 | 8.6 | 19.8 |
| Comparative Example No. | | | | | | | | | | |
| 1-21 | 15.1 | 6.8 | 3.1 | 7.0 | 43 | 614 | 54 | 1.27 | 15.4 | 14.9 |
| 1-22 | 18.7 | 5.9 | 2.9 | 6.5 | 41 | 632 | 55 | 1.01 | 13.7 | 13.5 |
| 1-23 | 16.8 | 4.8 | 2.5 | 5.5 | 36 | 654 | 56 | 1.32 | 12.1 | 11.0 |
| 1-24 | 13.4 | 4.4 | 2.4 | 5.3 | 34 | 644 | 57 | 0.95 | 11.6 | 19.3 |
| 1-25 | 24.4 | 5.5 | 2.6 | 6.0 | 39 | 640 | 55 | 2.03 | 12.2 | 26.1 |
| 1-26 | 12.1 | 6.2 | 3.0 | 6.4 | 40 | 623 | 53 | 1.28 | 13.8 | 18.5 |
| 1-27 | 17.5 | 5.1 | 2.7 | 5.7 | 37 | 644 | 55 | 1.99 | 12.7 | 25.5 |
| 1-28 | 16.7 | 6.2 | 3.1 | 7.1 | 46 | 657 | 56 | 1.27 | 14.8 | 11.1 |
| 1-29 | 16.6 | 5.6 | 2.6 | 6.4 | 39 | 615 | 54 | 1.22 | 12.8 | 15.1 |
| 2-21 | 17.1 | 7.0 | 3.1 | 7.4 | 58 | 777 | 50 | 1.34 | 15.6 | 14.7 |
| 2-22 | 19.0 | 6.8 | 2.9 | 6.4 | 50 | 778 | 51 | 1.30 | 14.0 | 16.8 |
| 2-23 | 18.8 | 6.8 | 2.8 | 6.4 | 49 | 763 | 52 | 1.28 | 13.8 | 16.1 |
| 2-24 | 16.2 | 6.0 | 2.3 | 5.5 | 45 | 811 | 52 | 1.07 | 11.3 | 24.4 |
| 2-25 | 25.7 | 7.2 | 3.1 | 6.8 | 53 | 777 | 52 | 2.62 | 14.3 | 31.2 |
| 2-26 | 14.8 | 7.6 | 3.2 | 7.0 | 54 | 765 | 48 | 1.44 | 14.2 | 23.9 |
| 2-27 | 18.0 | 7.5 | 3.3 | 7.1 | 55 | 770 | 49 | 2.54 | 15.9 | 29.9 |
| 2-28 | 18.7 | 7.1 | 2.9 | 6.6 | 51 | 766 | 56 | 1.23 | 13.7 | 16.1 |
| 2-29 | 18.6 | 6.2 | 2.7 | 5.8 | 45 | 778 | 54 | 1.29 | 12.5 | 14.9 |
| 3-15 | 17.4 | 6.8 | 3.3 | 7.3 | 62 | 845 | 46 | 0.97 | 14.8 | 15.4 |
| 3-16 | 19.5 | 6.0 | 2.6 | 5.7 | 47 | 819 | 45 | 1.13 | 12.6 | 17.2 |
| 3-17 | 19.0 | 5.9 | 2.6 | 5.2 | 43 | 834 | 46 | 0.84 | 11.3 | 17.2 |
| 3-18 | 14.8 | 6.4 | 2.6 | 6.0 | 49 | 812 | 45 | 1.18 | 12.5 | 24.1 |
| 3-19 | 25.6 | 6.1 | 2.6 | 5.9 | 50 | 837 | 46 | 2.47 | 12.3 | 30.5 |
| 3-20 | 15.4 | 5.9 | 2.5 | 5.8 | 48 | 814 | 44 | 2.03 | 12.9 | 25.5 |
| 3-21 | 16.2 | 7.5 | 3.4 | 7.2 | 58 | 803 | 43 | 2.39 | 15.7 | 28.1 |
| 4-15 | 16.1 | 7.0 | 3.2 | 6.9 | 53 | 776 | 47 | 1.27 | 14.2 | 15.6 |
| 4-16 | 17.9 | 6.4 | 3.0 | 6.7 | 53 | 786 | 48 | 1.39 | 13.9 | 19.2 |
| 4-17 | 17.7 | 6.3 | 2.5 | 6.1 | 48 | 788 | 49 | 1.17 | 13.0 | 18.7 |
| 4-18 | 15.0 | 5.1 | 2.0 | 5.6 | 45 | 813 | 50 | 1.98 | 12.0 | 25.5 |
| 4-19 | 25.3 | 5.5 | 2.6 | 5.2 | 43 | 828 | 52 | 2.43 | 11.1 | 31.5 |
| 4-20 | 13.9 | 7.2 | 3.3 | 7.3 | 55 | 759 | 46 | 2.07 | 15.9 | 26.6 |
| 4-21 | 16.5 | 6.2 | 2.8 | 5.9 | 48 | 810 | 48 | 2.41 | 11.9 | 30.1 |
| 5-15 | 17.7 | 7.2 | 3.5 | 7.6 | 63 | 828 | 42 | 0.99 | 16.4 | 16.1 |
| 5-16 | 18.9 | 6.5 | 2.8 | 6.4 | 52 | 819 | 42 | 1.24 | 13.9 | 18.3 |
| 5-17 | 19.4 | 5.4 | 1.8 | 5.3 | 43 | 816 | 45 | 0.83 | 11.0 | 20.0 |
| 5-18 | 15.9 | 5.6 | 2.3 | 5.5 | 46 | 838 | 43 | 1.04 | 11.8 | 26.3 |
| 5-19 | 26.3 | 5.6 | 2.3 | 5.4 | 45 | 838 | 44 | 2.56 | 11.7 | 32.6 |
| 5-20 | 14.7 | 7.1 | 3.0 | 6.7 | 55 | 823 | 39 | 1.99 | 14.3 | 26.6 |
| 5-21 | 17.8 | 7.6 | 3.5 | 7.3 | 60 | 822 | 44 | 2.33 | 15.5 | 29.7 |
| 16-21 | 16.0 | 6.0 | 2.7 | 6.6 | 38 | 576 | 61 | 1.24 | 13.5 | 10.1 |
| 16-22 | 19.6 | 5.1 | 2.6 | 6.2 | 37 | 595 | 62 | 1.01 | 11.9 | 8.8 |
| 16-23 | 17.5 | 3.9 | 2.1 | 5.1 | 32 | 617 | 64 | 1.33 | 10.2 | 6.1 |
| 16-24 | 14.2 | 3.6 | 2.1 | 5.1 | 31 | 606 | 65 | 0.90 | 10.1 | 14.3 |
| 16-25 | 25.3 | 4.6 | 2.2 | 5.6 | 33 | 602 | 63 | 2.16 | 10.4 | 21.1 |
| 16-26 | 13.0 | 5.5 | 2.5 | 6.0 | 35 | 585 | 62 | 1.26 | 12.0 | 13.7 |

TABLE 3-continued

| | GS (μm) 10-30 | DP area ratio (%) 5 or less | Average value of maximum width in field of vision where DP cells are observed (μm) 2 or less | ΔYS/ peak YS (%) 5 or less | ΔYS | YS (MPa) | EC (% IACS) | Bent surface mean roughness (μm) 1 or less | Rate of decrease in YS after heating at 500° C. × 30 min 10 or less | Number of continuous precipitates having particle size of 1 μm or greater (/1000 μm$^2$) 25 or fewer |
|---|---|---|---|---|---|---|---|---|---|---|
| 16-27 | 18.4 | 4.1 | 2.1 | 5.3 | 32 | 606 | 63 | 2.08 | 10.8 | 20.5 |
| 16-28 | 17.5 | 5.4 | 2.6 | 6.8 | 42 | 620 | 64 | 1.23 | 12.9 | 6.1 |
| 16-29 | 17.5 | 4.8 | 2.2 | 6.0 | 34 | 575 | 60 | 1.14 | 11.0 | 10.2 |
| 17-21 | 10.1 | 8.2 | 3.5 | 8.5 | 72 | 855 | 40 | 1.82 | 17.1 | 19.8 |
| 17-22 | 11.9 | 8.2 | 3.4 | 7.4 | 63 | 855 | 40 | 1.72 | 15.4 | 21.8 |
| 17-23 | 11.6 | 8.1 | 3.1 | 7.2 | 61 | 840 | 43 | 1.69 | 15.3 | 21.2 |
| 17-24 | 9.2 | 7.3 | 2.8 | 6.5 | 57 | 887 | 42 | 1.57 | 12.7 | 29.4 |
| 17-25 | 18.5 | 8.4 | 3.5 | 7.8 | 67 | 855 | 41 | 3.17 | 15.7 | 36.2 |
| 17-26 | 7.7 | 8.7 | 3.6 | 7.9 | 66 | 841 | 37 | 2.00 | 15.4 | 29.0 |
| 17-27 | 10.7 | 8.9 | 3.6 | 8.2 | 69 | 846 | 39 | 3.01 | 17.4 | 35.1 |
| 17-28 | 11.6 | 8.4 | 3.3 | 7.5 | 63 | 843 | 47 | 1.59 | 15.2 | 21.3 |
| 17-29 | 11.3 | 7.5 | 3.1 | 6.7 | 57 | 854 | 43 | 1.72 | 13.8 | 20.2 |
| 18-1 | 14.8 | 0.8 | 0.1 | 2.9 | 16.0 | 556 | 61 | 0.15 | 5.5 | 5.4 |
| 19-1 | Production was terminated due to cracks upon hot rolling. | | | | | | | | | |
| 20-1 | 16.5 | 3.4 | 1.1 | 3.4 | 20 | 598 | 59 | 0.45 | 6.2 | 11.8 |
| 21-1 | 16.2 | 2.5 | 0.9 | 3.2 | 20 | 612 | 52 | 0.52 | 6.9 | 9.2 |

REFERENCE NUMERALS

11 Discontinuous precipitation (DP) cell
12 Continuous precipitate

The invention claimed is:

1. A copper alloy for electronic materials, the copper alloy consisting of:

0.5% to 4.0% by mass of Co and 0.1% to 1.2% by mass of Si, optionally at least one alloying element selected from the group consisting of Cr, Sn, P, Mg, Mn, Ag, As, Sb, Be, B, Ti, Zr, Al, and Fe, the total amount of said alloying elements being 2.0% by mass or less, the balance of the copper alloy being Cu and unavoidable impurities, wherein the mass % ratio of Co and Si (Co/Si) is 3.5≤ Co/Si ≤5.5, an area ratio of discontinuous precipitation (DP) cells is 5% or less, and an average value of a maximum width of discontinuous precipitation (DP) cells is 2 μm or less.

2. The copper alloy for electronic materials according to claim 1, wherein a density of continuous precipitates having a particle size of 1 μm or greater is 25 or fewer particles per 1000 μm$^2$ in a cross-section parallel to a rolling direction.

3. The copper alloy for electronic materials according to claim 1, wherein the rate of decrease in 0.2% yield strength after heating for 30 minutes at a material temperature of 500° C. is 10% or less.

4. The copper alloy for electronic materials according to claim 1, wherein when 90° bending work is carried out in a W bending test in a bad way under the conditions under which a ratio of the sheet thickness and the bending radius is 1, a surface roughness Ra at a bent area is 1 μm or less.

5. The copper alloy for electronic materials according to claim 1, wherein the average grain size in the cross-section parallel to the rolling direction is 10 μm to 30 μm.

6. The copper alloy for electronic materials according to claim 1, wherein the peak 0.2% yield strength (peak YS), the overaged 0.2% yield strength (overaged YS), and the difference between the peak YS and the overaged YS (ΔYS) satisfy the relation: ΔYS/peak YS ratio ≤5.0%, with the proviso that the peak 0.2% yield strength (peak YS) is the highest 0.2% yield strength obtainable when an aging treatment is carried out by setting the aging treatment time to 30 hours and changing the aging treatment temperature by 25° C. each time; and the overaged 0.2% yield strength (overaged YS) is the 0.2% yield strength obtainable when the aging treatment temperature is set to a temperature higher by 25° C. than the aging treatment temperature at which the peak YS was obtained.

7. The copper alloy for electronic materials according to claim 1, wherein the copper alloy contains at least one alloying element selected from the group consisting of Cr, Sn, P, Mg, Mn, Ag, As, Sb, Be, B, Ti, Zr, Al, and Fe, and the total amount of the alloying elements is 2.0% by mass or less.

8. A method for producing the copper alloy for electronic materials according to claim 1, the method comprising:

step 1: melting and casting an ingot consisting of:

0.5% to 4.0% by mass of Co and 0.1% to 1.2% by mass of Si, optionally at least one alloying element selected from the group consisting of Cr, Sn, P, Mg, Mn, Ag, As, Sb, Be, B, Ti, Zr, Al, and Fe, the total amount of said alloying elements being 2.0% by mass or less, the balance of the copper alloy being Cu and unavoidable impurities, wherein the mass % ratio of Co and Si (Co/Si) is 3.5 ≤ Co/Si ≤5.5;

step 2: then, heating the material for one hour or longer at a material temperature of from 950° C. to 1070° C., and then performing hot rolling, provided that the average cooling rate employed for the period in which the material temperature decreases from 850° C. to 600° C. is set to equal to or greater than 0.4° C/s and less than or equal to 15° C/s, and the average cooling rate employed at or below 600° C. is set to 15° C/s or greater;

step 3: then, optionally repeating cold rolling and annealing, provided that in the case of performing an aging treatment for annealing, the aging treatment is carried out at a material temperature of 450° C. to 600° C. for 3 hours to 24 hours, and in the case of performing cold rolling immediately before the aging treatment, the working ratio is set to 40% or less or 70% or greater;

step 4: then, conducting a solution treatment, provided that the maximum arrival temperature of the material during the solution treatment is set to 900° C. to 1070° C., the time for which the material temperature is maintained at the maximum arrival temperature is set to 480 seconds or less, and the average cooling rate employed for the period in which the material temperature decreases from the maximum arrival temperature to 400° C. is set to 15° C/s or greater; and step 5: then, conducting an aging treatment, provided that in the case of performing cold rolling immediately before the aging treatment, the working ratio is set to 40% or less or 70% or greater.

9. The method for producing a copper alloy for electronic materials according to claim 8, the method comprising conducting any one of items (1) to (4') after the step 4:

(1) cold rolling→aging treatment (step 5)→cold rolling;

(1') cold rolling→aging treatment (step 5)→cold rolling→(low temperature aging treatment or stress relief annealing);

(2) cold rolling→aging treatment (step 5);

(2') cold rolling→aging treatment (step 5)→(low temperature aging treatment or stress relief annealing);

(3) aging treatment (step 5)→cold rolling;

(3') aging treatment (step 5)→cold rolling→(low temperature aging treatment or stress relief annealing);

(4) aging treatment (step 5)→cold rolling→aging treatment; or (4') aging treatment (step 5)→cold rolling→aging treatment→(low temperature aging treatment or stress relief annealing);

with the proviso that the low temperature aging treatment is carried out at 300° C. to 500° C. for 1 hour to 30 hours.

10. A wrought copper product obtained by processing the copper alloy for electronic materials according to claim 1.

11. An electronic component comprising the copper alloy for electronic materials according to claim 1.

* * * * *